US012059724B2

(12) United States Patent
Zumbusch et al.

(10) Patent No.: US 12,059,724 B2
(45) Date of Patent: Aug. 13, 2024

(54) PRODUCTION METHOD, CASTING MOULDS, CORES OR FEEDERS AND KIT AND METHOD FOR PRODUCTION OF A METALLIC CASTING

(71) Applicants: HÜTTENES-ALBERTUS Chemische Werke Gesellschaft mit beschränkter Haftung, Düsseldorf (DE); HUTTENES ALBERTUS FRANCE, Brenouille (FR); Chemex Foundry Solutions GmbH, Delligsen (DE)

(72) Inventors: Lars Zumbusch, Langenfeld (DE); Manuel Vargas, Pont-Sainte-Maxence (FR); Sven Dommen, Düsseldorf (DE)

(73) Assignees: HÜTTENES-ALBERTUS CHEMISCHE WERKE BESCHRÄNKTER HAFTUNG, Düsseldorf (DE); HUTTENES ALBERTUS FRANCE, Brenouille (FR); CHEMEX FOUNDRY SOLUTIONS GMBH, Delligsen (DE)

( * ) Notice: Subject to any disclaimer, the term of this patent is extended or adjusted under 35 U.S.C. 154(b) by 0 days.

(21) Appl. No.: 18/039,115

(22) PCT Filed: Nov. 26, 2021

(86) PCT No.: PCT/EP2021/083204
§ 371 (c)(1),
(2) Date: May 26, 2023

(87) PCT Pub. No.: WO2022/112515
PCT Pub. Date: Jun. 2, 2022

(65) Prior Publication Data

US 2024/0001433 A1 Jan. 4, 2024

(30) Foreign Application Priority Data

Nov. 27, 2020 (DE) ..... 102020131492.2

(51) Int. Cl.
*B22C 1/02* (2006.01)
*B22C 1/18* (2006.01)
(Continued)

(52) U.S. Cl.
CPC ..... *B22C 1/02* (2013.01); *B22C 1/224* (2013.01); *B22C 1/2253* (2013.01);
(Continued)

(58) Field of Classification Search
CPC ..... B22C 1/02; B22C 1/188; B22C 1/224; B22C 1/2253; B22C 1/226; B22C 1/2273; B22C 9/02; B22C 9/088; B22C 9/10
See application file for complete search history.

(56) References Cited

U.S. PATENT DOCUMENTS 3,273,211 A 9/1966 Miraldi
2001/0000180 A1 4/2001 Fernandez
(Continued)

FOREIGN PATENT DOCUMENTS

DE 19617938 A1 11/1997
DE 19920570 A1 11/2000
(Continued)

OTHER PUBLICATIONS

Iden, F., et al., "Structures of cold box binder systems and the possibility of their modification", Foundry Review, 2011, vol. 58, Issue 1/2.
(Continued)

*Primary Examiner* — Kevin E Yoon
(74) *Attorney, Agent, or Firm* — DUANE MORRIS LLP; Gregory M. Lekowitz

(57) ABSTRACT

The invention relates to a method of producing an article selected from the group consisting of casting mold, core, feeder and molding compound for production of part of a casting mold, core or feeder, comprising the following steps:
(Continued)

Figure 1:
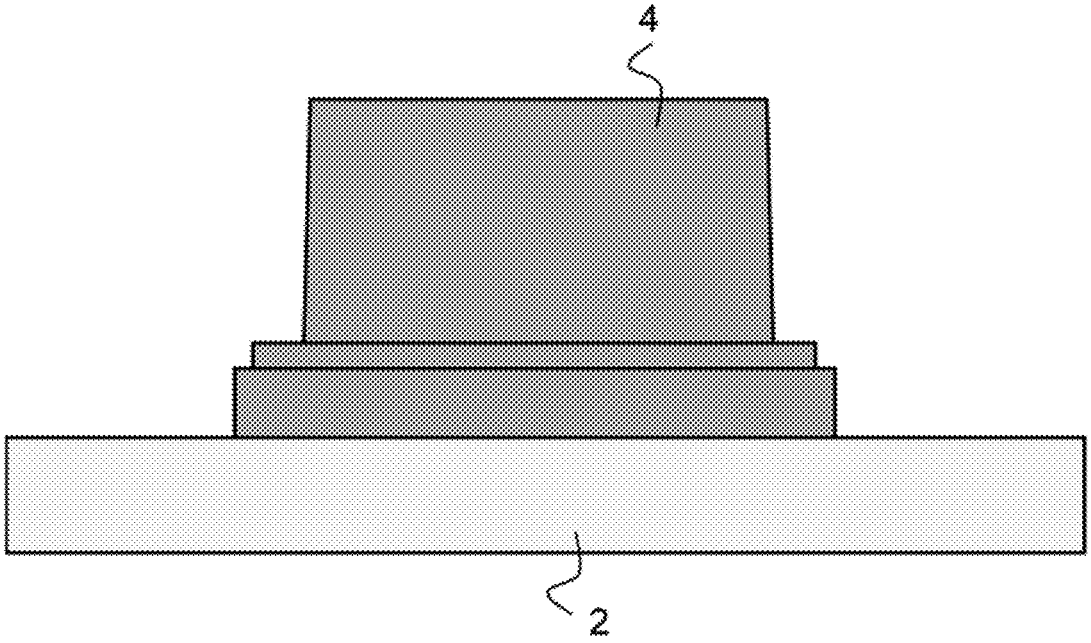

(S1) producing or providing in the foundry:

a first component (A), comprising a first binder component (b1) of a binder system and an amount of a first mold base material and, spatially separated therefrom, a second component (B), comprising a second binder component (b2) of the binder system and an amount of a second mold base material wherein the first binder component (b1) and the second binder component (b2) are suitable for chemical reaction with one another and for curing of a mixture of the first component (A) and the second component (B), (S2) mixing by contacting the first component (A) and the second component (B) in a particular mass ratio, so as to result in a self-curing molding compound.

19 Claims, 6 Drawing Sheets

(51) Int. Cl.

| | |
|---|---|
| ***B22C 1/22*** | (2006.01) |
| ***B22C 9/02*** | (2006.01) |
| ***B22C 9/08*** | (2006.01) |
| ***B22C 9/10*** | (2006.01) |

(52) U.S. Cl.

CPC ..... *B22C 1/2273* (2013.01); *B22C 9/02* (2013.01); *B22C 9/088* (2013.01); *B22C 9/10* (2013.01)

(56) References Cited

U.S. PATENT DOCUMENTS

| | | | |
|---|---|---|---|
| 2011/0315911 | A1 | 12/2011 | Lanver |
| 2019/0047041 | A1 | 2/2019 | Ladégourdie |
| 2019/0091758 | A1 | 3/2019 | Ladégourdie |
| 2019/0118244 | A1 | 4/2019 | Lehmann |
| 2020/0391279 | A1 | 12/2020 | Bach |
| 2021/0107055 | A1 | 4/2021 | Reinold |

FOREIGN PATENT DOCUMENTS

| | | | | |
|---|---|---|---|---|
| DE | 10065270 | A1 | 7/2002 | |
| DE | 69716248 | T2 | 8/2003 | |
| DE | 10104289 | B4 | 11/2004 | |
| DE | 102012200967 | A1 | 7/2013 | |
| EP | 1728571 | B1 | 9/2008 | |
| GB | 1029057 | | 5/1966 | |
| WO | WO-2018184601 | A1 * | 10/2018 | ..... B22C 1/22 |
| WO | WO-2019208322 | A1 * | 10/2019 | ..... B22C 1/2253 |

OTHER PUBLICATIONS

Franke, S., entry on "exothermes Heizkissen [exothermic heating pad]," Foundry Lexikon, Schiele &Schön, 2019, 20th Edition, p. 98.

Bührig-Polaczek, A., et al., "Primary Forming Handbook—Handbook of Production Engineering," chapter 1.5.3—Production of lost molds and cores using permanent models, Carl Hanser Verlag Gmbh & Co. KG, 2013, ISBN 978-3-446-42035-9.

Franke, S., entry on "Isolierkissen [insulation pads]", Foundry Lexikon, Schiele &Schön, 2019, 20th Edition, p. 387-388.

VDG Merkblatt (i.e. worksheet from the "Verein deutscher Gießereifachleute" [Society of German Foundry Experts]) p. 27, dated Oct. 1999, point 4.3.

* cited by examiner

PRODUCTION METHOD, CASTING MOULDS, CORES OR FEEDERS AND KIT AND METHOD FOR PRODUCTION OF A METALLIC CASTING

CROSS-REFERENCE TO RELATED APPLICATIONS

This application is a § 371 national stage entry of International Application No. PCT/EP2021/083204, filed on Nov. 26, 2021, which claims priority to German Patent Application No. 102020131492.2, filed on Nov. 27, 2020, the entire contents of which are incorporated herein by reference.

The present invention relates to a method of producing an article selected from the group consisting of casting mold, core, feeder and molding compound, self-curing or cured, for production of part of a casting mold, core or feeder. Further details of the method of the invention will be apparent from the appended claims and from the description that follows. The present invention additionally relates to casting molds, cores and feeders. The present invention further relates to a kit for use in a method of the invention. The present invention additionally relates to a method of producing a metallic casting by metal casting in a casting mold. The invention is defined in the appended claims and is elucidated in detail in the description that follows.

Casting in a lost mold is a widely practiced method of producing near-net-shape components. After casting, the mold is destroyed, and the casting is removed. Lost molds are casting molds and hence negatives. They contain the cavity to be cast, which surrounds the casting to be manufactured. The internal outlines of the future casting are formed by cores. In the production of casting molds, the cavity is shaped in the molding material by means of a model of the casting to be manufactured. Reference is made to the relevant details in paragraphs [0001] to [0005] of document DE 10 2017 107 531 A1.

In the production of metallic castings (cast articles) in the foundry industry, liquid metal is introduced into a casting mold, where it solidifies. The solidifying operation is associated with a decrease in metal volume; therefore, feeders in or on the casting mold are regularly used in order to compensate for the deficit in volume in the solidification of the casting and hence to prevent formation of cavities in the casting. Feeders are connected to the casting or to the casting region at risk, and are usually present above and/or at the side of the mold cavity. Reference is made to the relevant details in paragraph in document DE 10 2012 200 967 A1.

Document EP 0 913 215 B1 discloses a composition suitable for production of insulating or exothermic feeders and other filling funnels and feed elements for casting molds by blow molding and cold box curing, said composition containing: (i) hollow aluminosilicate microbeads having an alumina content below 38% by weight, (ii) a binder for cold box curing; and optionally (iii) filler, where the filler is in nonfibrous form.

Document DE 10 104 289 B4 discloses a shapeable exothermic composition for production of feeders for the foundry industry, comprising a readily oxidizable metal, an oxidizing agent for the readily oxidizable metal, a particulate filler and a binder, wherein the composition comprises a proportion of a lithium silicate that influences ignition characteristics.

Document DE 69 716 248 T2 discloses a feeder having exothermic properties, insulating properties, or both, obtainable by a cold box method comprising (A) introducing a feeder mixture into a feeder casting mold for production of an uncured feeder, wherein the feeder mixture comprises: (1) a feeder composition that can produce a feeder, wherein the feeder composition comprises: (a) an oxidizable metal and an oxidizing agent that can create an exothermic reaction; or (b) an insulating refractory material; or (c) mixtures of (a) and (b); (2) an effective amount of a chemically reactive cold box binder, selected from phenolic resins, phenolic urethane binders, furan binders, alkaline phenol-resol binders and epoxyacrylic binders; (B) contacting the uncured feeder that has been produced in (A) with a vaporous curing catalyst; (C) allowing the feeder obtained by (B) to harden until the feeder can be handled; and (D) removing the feeder from the casting mold.

Document DE 10 065 270 B1 discloses a shapeable exothermic composition for production of feeders for the foundry industry, comprising: a particulate (granular) filler, an organic binder system and an oxidizing agent for the binder system, wherein the composition comprises between 0% and 4% by weight of a readily oxidizable metal and the proportion of oxidizing agent is in the range between 5% and 40% by weight. Also disclosed is a method of producing a shapeable exothermic composition for production of feeders for the foundry industry, having the following step: mixing a readily oxidizable metal, an oxidizing agent for the readily oxidizable metal, a particulate filler, a binder, and an amount of a lithium silicate that influences ignition characteristics.

Document DE 196 17 938 A1 discloses a feeder insert consisting of a mixture of insulating and/or exothermic constituents and customary admixtures that has been bound by a binder to give a shaped body, wherein a polyurethane-based binder is used, the components of which include a phenolic resin containing free OH groups and a polyisocyanate as co-reactant, at least one of which is dissolved in a solvent consisting predominantly or entirely of vegetable oil methyl esters.

The technical article "Strukturen von Cold-Box-Bindersystemen and die Moglichkeit ihrer Veränderungen" [Structures of Cold Box Binder Systems and the Possibility of Changes Thereto] by the authors F. Iden, U. Pohlmann, W. Tilch and H. J. Wojtas appearing in technical magazine Giesserei-Rundschau, 58, 1/2 (2011) discloses fundamentals relating to the strength of cold box binders.

The prior art thus already discloses methods of producing casting molds, cores, feeders and molding compounds.

The prior art additionally discloses that feeders having insulating or exothermic properties can be produced.

There is a general need in the technical field of the present invention to produce casting molds, cores, feeders and molding compounds in the foundry with a low level of apparatus complexity. In many cases, especially in the production of prototypes in the field of the present invention, the use of complex metering and mixing devices is undesirable.

Moreover, there is a need to avoid apparatus complexity in the curing of molding compounds. In many cases, it is particularly desirable in the field of the present invention, especially in the iterative production of prototypes and in the repair of surface defects or in the filling of intended recesses in casting molds, cores or feeders, if no apparatus is needed in the metering, mixing and curing.

In the production of casting prototypes, there is frequently formation of cavities; even the use of suitable feeders cannot prevent cavity formation in all cases. In the field of the present invention, it is known that mounting of exothermic heating pads at suitable sites on corresponding casting molds or cores can avoid cavity formation in many cases. Such exothermic heating pads are known in the prior art, for example from EP 1 728 571 B1, DE 199 205 70 A1 or the GieRerei Lexikon [Foundry Lexicon] (cf. entry on "exothermes Heizkissen" [exothermic heating pad], page 198 in the GieRerei Lexikon, published by Simone Franke, Verlag Schiele and Schorr, Berlin; 20th edition, 2019; ISBN: 978-3-7949-0916-2).

The production of exothermic heating pads is costly and additionally takes a great deal of time, which is perceived as being disadvantageous in the field of the foundry industry. Moreover—especially in the case of complex molding prototypes—it is not possible in many cases to reliably predict the regions in which, and in what size, a corresponding exothermic heating pad has to be provided, or whether cavity formation can be avoided at all by means of an exothermic heating pad in a specific individual case. It is therefore especially desirable in the context of the present invention to determine, without high expenditure and/or without taking much time, the sites at which, and in what amount, exothermic heating pads can be used in a particular casting mold in order to counteract cavity formation.

In particular, there is a need for methods that wholly or partly meet the aforementioned demands and can at the same time be implemented in a resource-efficient manner in the foundry.

Moreover, there is a growing need in the field of the present invention for methods that can be implemented in an energy-efficient manner and with environmentally conserving use of resources.

The present invention relates to:

- a method of producing an article selected from the group consisting of casting mold, core, feeder and molding compound for production of part of a casting mold, core or feeder, preferably for production of a prototype of a casting mold, a core or a feeder or for production of a casting mold, core or feeder by repair or completion of a corresponding defective or incomplete article,
- an article selected from the group consisting of casting mold, core, feeder,
- a kit for use in a method of the invention,
- a method of producing a metallic casting by metal casting in a casting mold.

Particular embodiments, aspects or properties that are described or identified as preferred in association with one of these categories are each considered to be applicable correspondingly or analogously for the respective other categories as well, and vice versa.

Unless stated otherwise, preferred aspects or embodiments of the invention and the various categories thereof can be combined with other aspects or embodiments of the invention and the various categories thereof, especially with other preferred aspects or embodiments. Combinations of respectively preferred aspects or embodiments with one another each again give rise to preferred aspects or embodiments of the invention.

In a primary aspect of the present invention, the above-specified problems are solved and objectives are achieved by a method of producing an article selected from the group consisting of casting mold, core, feeder and molding compound, self-curing or cured, for production of part of a casting mold, core or feeder, having at least the following steps:

(S1) producing or providing in the foundry:

- a first component (A), comprising a first binder component (b1) of a binder system and an amount of a first mold base material and, spatially separated therefrom,

- a second component (B), comprising a second binder component (b2) of the binder system and an amount of a second mold base material wherein

- the first binder component (b1) and the second binder component (b2) are suitable for chemical reaction with one another and for curing of a mixture of the first component (A) and the second component (B), (S2) mixing by contacting at least the first component (A) and the second component (B) in a particular mass ratio, so as to result in a self-curing molding compound.

In step (S2), the first component (A) and the second component (B) are mixed by contacting in a predetermined mass ratio, so as to result in a self-curing molding compound; at the same time or thereafter, one (third) or more further components may be brought into contact with the mixture of those two components. In many cases, however, preference is given, in step (S2), to the use of exclusively a first component (A) and a second component (B). In some other cases, a third component is added in the mixing of the first component (A) and the second component (B) or after the mixing of these components. Preferred third or further component(s) used is/are frequently customary admixtures (additives) as already used in foundry practice in the production of molding material mixtures. For example, third components used may be color pigments. In some cases, it is preferable that the third component comprises a catalyst (for curing of the first binder component (b1) and the second binder component (b2) with one another). In other cases, it is preferable that the third component is a catalyst (for curing of the first binder component (b1) and the second binder component (b2) with one another). The one or more further components used become part of the self-curing molding compound.

The first component (A) comprises a first binder component (b1) of a binder system and an amount of a first mold base material; further constituents are additionally present if appropriate. The second binder component (b2) of the binder system is not present in the first component (A).

The second component (B) comprises a second binder component (b2) of the binder system and an amount of a second mold base material; further constituents are additionally present if appropriate. The first binder component (b1) of the binder system is not present in the second component (B).

Only when the first component (A) and the second component (B) are mixed by contacting in step (S-2) do the first binder component (b1) and the second binder component (b2) come into contact, so as to result in a self-curing molding compound. The first component (A1), by contrast, is not a self-curing molding compound since it contains solely the binder component (b1), but not the binder component (b2). The second component (B1) is likewise not a self-curing molding compound since it contains solely the binder component (b2), but not the binder component (b1).

In many cases, one of the two components (A) and (B) comprises (as a further constituent) a catalyst for curing the first binder component (b1) and the second binder component (b2) with one another.

The "production" of casting mold, core or feeder is preferably a production by repair or completion of a corresponding precursor.

A binder system used in the method of the invention comprises or consists of the two binder components mentioned: the first binder component (b1) and the second binder component (b2); in step (S1) of the method of the invention, the first binder component (b1) and the second binder component (b2) are each present as constituents of the first component (A) (comprising the first binder component (b1)) or the second component (B) (comprising the second binder component (b2)) in spatially separate containers.

Preferred configurations of the method of the invention are defined in the description that follows and in the appended claims.

It has been necessary to date, in the methods known from the prior art, even for simple self-curing molding compounds, to dose at least one mold base material and two binder components on site in the foundry; as a result, such methods, in many cases, could be conducted only with a time demand or need for apparatus that was unacceptable for the needs especially of prototype production and repair (see above). The method of the invention now enables the production of a self-curing molding compound by the mixing by contacting of only two previously produced or provided components, namely the first component (A) and the second component (B), in a predetermined mixing ratio without any need for dosage steps for the individual substances present in the first component (A) or the second component (B) (especially binder component) on site in the foundry. Components (A) and (B), each in themselves, are preferably not self-curing and are storage-stable over a number of weeks.

In the method of the invention, it is possible to use a multitude of binder systems, the constituents of which take the form of the first binder component (b1) and of the second binder component (b2) and, by chemical reaction with one another, are suitable for curing of a mixture of the first components (A) and the second component (B). In each case, the binder components (b1) and (b2) mentioned may be combined with different mold base materials and optionally further substances, such that, even in the production and/or provision of the first component (A) and the second component (B), skilled selection of the compositions can result in suitable consistencies and setting times of the self-curing molding compound that arises in step (S2); in this way, the demands on the articles that result as intermediates or products in the method of the invention, depending on the respective needs of the individual case, are satisfied in a particularly simple and efficient manner by the method of the invention.

Components (A) and (B) that are produced or provided in step (S1), i.e. the first component (A) and the second component (B), comprise, as one of several constituents, an amount of each of the first and second mold base materials.

In the method of the invention, preference is given to using refractory mold base materials and/or thermally insulating fillers as mold base material. In some cases, in the method of the invention, preference is given to using thermally insulating fillers and refractory mold base materials in combination as mold base material. Suitable selection of the mold base material used in the method of the invention respectively as a constituent of the first component (A) or of the second component (B) allows the thermal conductivity or insulating properties of the molding compound that arises in step (S2) and of the articles produced therefrom to be influenced in a controlled manner.

"Refractory" in the present text, in accordance with the customary understanding of the person skilled in the art, refers to compounds, materials and especially mold base materials that can at least briefly withstand the thermal stresses in the casting operation, or in the solidification of a metal melt, preferably a steel, iron or cast iron melt, but also, for example, a bronze or aluminum melt; preferably compounds, materials and especially mold base materials that are defined as "refractory" according to DIN 51060 in the version of June 2000. Suitable refractory mold base materials are natural and synthetic refractory mold base materials, for example quartz sand, zircon sand or chromite sand, olivine, vermiculite, bauxite or fireclay.

Thermally insulating fillers used are preferably materials having lower thermal conductivity than the aforementioned refractory mold base materials. Particular preference is given to the thermally insulating fillers as used with preference in the method of the invention, selected from the group consisting of:

hollow bodies, preferably hollow spheres of fly ash.
porous bodies, preferably perlite, calcined rice husk ash, calcined kieselguhr, closed-pore microspheres,
core-shell particles
and mixtures thereof.

Calcined kieselguhr as used with preference in the context of the method of the invention is described, for example, in DE 10 2012 200 967 A1. Closed-pore hollow microspheres as used with preference in the context of the method of the invention are described, for example, in WO 2017/174826 A1.

Thermally insulating core-shell particles as used with preference in the context of the method of the invention are described, for example, in EP 2 139 626 B1.

The first component (A) produced or provided in step (S1) comprises an amount of a first mold base material, and the second component (B) produced or provided spatially separately therefrom in step (S1) comprises an amount of a second mold base material; the first mold base material and second mold base material used in many cases are different mold base materials. In many cases, however, it is also preferable to use the same mold base material as the first mold base material and as the second mold base material.

It is preferable in many cases when the first binder component (b1) in the first component (A) is partly or fully premixed, preferably fully premixed, with the amount of the first mold base material, and when the second binder component (b2) in the second component (B) is partly or fully premixed, preferably fully premixed, with the amount of the second mold base material.

The term "molding compound" encompasses both a "self-curing molding compound" and a "cured molding compound". The "self-curing molding compound" is an intermediate in the production of the "cured molding compound" or of a "cured shaped product" (of the first component (A) and the second component (B)). Casting molds, cores and feeders are articles that comprise or consist of a "cured molding compound" or a "cured shaped product" (of the first component (A) and of the second component (B)), preferably for the purpose of repair or completion of a corresponding (incomplete or defective) precursor (base body). A molding compound, self-curing or cured, is suitable for production of part of a casting mold, core or feeder.

The "mixing by contacting" of the first component (A) and the second component (B) in step (S2) commences as soon as the first component (A) is brought into contact with the second component (B) and ends when the mixing operation gives a self-curing molding compound.

The term "self-curing" means that curing proceeds without further measures; however, further measures to assist curing are not ruled out. The person skilled in the art will decide according to the requirements of the individual case whether the self-curing of the self-curing molding compound is or should be assisted by methods of assisting curing on performance of the method of the invention.

What is meant by mixing of the first component (A) and the second component (B) in the mixing by contacting with one another in a predetermined mass ratio in step (S2) is that predefined masses of each of the individual components (for example according to a formulation) are used. In many cases, it is preferable when the first component (A) and the second component (B) in step (S1) are each already produced or provided in these predefined masses, such that the said predefined masses of said components (A) and (B) are each used in their entirety in step (S2); in these cases, there is no additional dosage step between the producing or providing in step (S1) and the mixing by contacting of the first component (A) and the second component (B) with one another in a predetermined mass ratio in step (S2).

By these methods, the above-identified articles or parts of foundry molds, cores and feeders are produced in a particularly efficient and time- and resource-conserving manner, especially as prototypes and/or in a production by repair or completion of a precursor.

The invention relates more particularly and preferably to a method (as described above, preferably as identified above as preferred), wherein the self-curing molding compound that arises in step (S2) is kneaded by machine and/or manually, preferably manually, and preferably mixed homogeneously in one or more subsequent steps (cf. also the details further down relating to a further step (S3)).

In many cases, it is preferable on implementation of the method of the invention when the resulting self-curing molding compound is mixed by kneading, preferably mixed homogeneously by kneading, preferably kneaded manually; in such cases, the material is a modelable plastic mass which is deformable, preferably manually deformable. The molding compound can thus preferably be irreversibly deformed under preferably manual application of force after a yield point has been surpassed, and retains the shape attained after the application of force. Self-curing molding compounds that are kneaded in the preferred method of the invention are non-free-flowing.

Mixing by contacting in step (S2), preferably manual kneading (preferably mixing by kneading) is followed, in one development of the method of the invention, by the step of preferably manual shaping of the self-curing molding compound onto other articles, especially and preferably onto shaped bodies, for example for completion or repair of an incomplete or defective precursor (base body). For example, the manual filling of surface defects with self-curing molding compound or the manual modeling of self-curing molding compound onto the surface of mold parts is also considered to be covered by manual shaping-on, provided that these methods include manual compression and shaping. The operation of kneading and preferably also the operation of shaping-on the molding compound is preferably ended before the curing process of the molding compound has concluded or (even better) before it sets in; in this way, destruction of already formed binder bridges within the molding compound is avoided.

When the self-curing molding compound is kneaded in the method of the invention, it is possible in many cases to work in an even more resource-conserving manner and additionally to conduct the method faster in some cases. For example, in the method of the invention, the kneading of the self-curing molding compound in the manual modeling of self-curing molding compound onto the surface of mold prototypes results in replication of the outlines of these mold prototypes without having to create a mold for this purpose, and without having to combine more than the first component (A) and the second component (B) on site in the foundry.

Preference is given to a method of the invention (as described above, preferably as identified above as preferred), for production of an article selected from the group consisting of casting mold, core and feeder, comprising the step of:

(S3) shaping (preferably manually shaping) and curing the self-curing molding compound that arises in step (S2), so as to result in a cured molded product of the first component (A) and of the second component (B), which preferably forms the article or a region of the article on conclusion of the production method, wherein the method is preferably a method of production by repair or completion.

Especially in methods of production by repair or completion, the cured shaped product forms a region of the article.

The self-curing molding compound that arises in step (S2) from mixing by contacting of the first component (A) and the second component (B) in a predetermined mass ratio is shaped and cured in step (S3), so as to result in a cured shaped product of the first component (A) and the second component (B).

Preferably, the shaping of the self-curing molding compound that arises in step (S2), in step (S3), is a kneading operation, preferably a manual kneading operation, preferably manual mixing by kneading (see above).

The curing in step (S3) may be exclusively self-curing or may be assisted, for example, by the methods of curing mentioned below or other methods of curing that are known to the person skilled in the art.

In many cases, the self-curing of the self-curing molding compound in the method of the invention is not assisted by methods of assisting the curing; in particular, the curing is then not effected in the presence of gaseous catalysts and/or not in the presence of gaseous co-reactants.

In some cases, however, in the method of the invention, the curing of the self-curing molding compound is assisted by suitable equipment and/or use of suitable apparatuses; the assisting measures should be matched to the properties and curing mechanisms of the first and second binder components (b1) and (b2).

The assistance may be implemented, for example, by controlled gassing of the shaped molding material mixture (preferably having been shaped by manual kneading) with air at a controlled temperature, as known to the person skilled in the art by the process of hot curing (thermal curing). The air is preferably at a temperature of 100° C. to 250° C., more preferably of 110° C. to 180° C. Depending on the binder type chosen (for example in the case of use of phenolic resin condensed under alkaline conditions (phenol resol) in combination with oxyanion ("resol-$CO_2$ method") or in the case of use of waterglass as binder), the curing of the molding compound can also be assisted by gassing with $CO_2$ or with a $CO_2$-air mixture.

The curing of the shaped self-curing molding compound, in some preferred cases, is also assisted by the action of microwaves or by the action of electromagnetic radiation, especially infrared radiation. For this purpose, the shaped self-curing molding compound may be stored in an oven or exposed to another heat source, for example an IR source or an open flame, in order to accelerate the curing operation.

In some cases, the curing of the shaped self-curing molding compound is also assisted by passage of electrical current through the shaped self-curing molding compound;

details are disclosed, for example, in DE 10 2017 217 098 B3 and the literature cited therein.

The curing of the shaped self-curing molding compound is also assisted in some cases by the use of carbon dioxide, as described, for example, in chapter 1.5.3 of the textbook Buhring-Polaczek, Michaeli and Spur: Handbuch Urformen [Primary Forming Handbook] (2013), Carl Hanser Verlag GmbH & Co. KG, ISBN 978-3-446-42035-9.

The curing of the shaped self-curing molding compound is also assisted in some cases by the use of esters, as described, for example, in GB 1 029 057 or in chapter 1.5.3 of the textbook Buhring-Polaczek, Michaeli and Spur: Handbuch Urformen (2013), Carl Hanser Verlag GmbH & Co. KG, ISBN 978-3-446-42035-9.

It is also possible to combine cold curing methods and applications in the additive manufacturing sector with methods of the invention.

What is meant by forming of the article or a region of the article by the cured shaped product of the first component (A) and the second component (B) on conclusion of the production method is that (i) the article consists exclusively of the cured shaped product of the first components (A) and the second component (B), or (ii) the cured shaped product of the first component (A) and the second component (B) forms a region of the article, preferably a region of the article that comes into contact with cast metal on casting of the article, and the remainder of the article consists of a different material.

In some cases, in the production of casting molds or cores, unwanted defects arise at the surface of the casting mold or core intended for contact with the casting metal. Preferably, in such cases, the self-curing molding compound that arises in step (S2) is kneaded in the method of the invention, preferably kneaded manually, and used for repair, namely for filling of such surface defects, regardless of whether the casting mold or core consists of the same material as the cured shaped product formed from the self-curing molding compound. In such cases in which the defective casting mold or defective core consists of a different material than the cured shaped product, the cured shaped product forms a region (for example a filled cavity) in the completed article (for example casting mold), i.e. that is produced by repair. More preferably, the cured shaped product forms a region of the article that comes into contact with the liquid casting metal on casting.

In a preferred configuration of the method of the invention, the article produced thereby, consisting essentially and preferably consisting entirely of the cured shaped product of the first component (A) and the second component (B), is a contour pad. The term "contour pad" in the context of the present invention is understood to mean mold inserts produced from molding compound or molding material that form a region of the casting mold that at least partly follows the outlines of the later casting. Contour pads which, on account of their ingredients, are capable of a thermite reaction after activation by contact with liquid casting metal are also referred to as "exothermic heating pads" within the present text in accordance with the customary understanding of the person skilled in the art; in this respect, see also the details relating to exothermic heating pads further down in the present text. The "insulation pads" known to the person skilled in the art (cf. entry on "Isolierkissen" [insulation pads], pages 387-388 in the GieRerei Lexikon, edited by Simone Franke, Verlag Schiele and Schon, Berlin; 20th edition, 2019; ISBN: 978-3-7949-0916-2) are likewise contour pads.

Such a contour pad is preferably produced in a foundry using apparatus aids, especially by means of a molding box. Such a separately produced contour pad is produced independently of a casting mold used for casting of a workpiece.

With the aid of the self-curing molding compound that arises in step (S2), such a contour pad can be produced as required in a foundry and in a simplified manner, even manually.

In many cases, in the method of the invention, the self-curing molding compound is shaped manually onto a shaping model, in which case the manual shaping-on has preferably been preceded by kneading. The use of additional apparatus aids is preferably avoided in these cases.

One or more contour pads that have been automatically prefabricated or shaped manually on site (preferably shaped by kneading) are preferably placed or shaped into recesses present in a base body (i.e. a precursor) of a casting mold. By means of one or more corresponding contour pads, regions of the casting mold used for production of the casting are preferably formed, which come into contact with the liquid casting metal in the casting operation.

Preference is given to a method of the invention (as described above, preferably as identified above as preferred) wherein the article, for bounding of at least sections of a cavity to accommodate cast metal, has a first boundary region and an adjacent, preferably adjoining, second boundary region of different composition, wherein the first boundary region is formed from the cured shaped product of the first component (A) and the second component (B). The second boundary region may, for example, be part of the base body (precursor) of a casting mold. The first boundary region may be part of the filled recesses of such a base body; such recesses are preferably filled on production of the article by repair or completion of the precursor.

Details will be apparent from the appended drawings and the elucidations further down in the present text.

Preference is given to a method of the invention (as described above, preferably as identified above as preferred) wherein the first component (A) and/or the second component (B) comprise constituents present at least in the cured shaped product after step (S3) or in the article after conclusion of the production method such that they can be made to react with one another in a thermite reaction for example an aluminothermic reaction, by heating.

In many cases, it is preferable when articles after conclusion of the production method are in such a form that at least the ingredients of individual regions, by suitable activation, can be made to react with one another in a strongly exothermic reaction, preferably a thermite reaction, for example an aluminothermic reaction. In particular, it is preferable when these are regions of the article that have been shaped in a method according to the invention.

Thermite reactions are known to the person skilled in the art. In the method of the invention, it is preferable when the thermite reaction is activated by the liquid metal during the casting. In some cases, it is preferable when the casting with the liquid casting metal results in a thermite reaction; in that case, the substances used in the method of the invention will be those known to the person skilled in the art that react with one another in a thermite reaction after suitable activation, as a constituent of one or both of the first component (A) and second component (B) produced or provided in step (S1). For example, the person skilled in the art will use aluminum in the first component (A) and/or the second component (B) and iron oxide in the respectively identical and/or other of the said components (A) and (B). It is likewise also possible to add other metals such as copper, nickel, titanium, chromium and manganese in order to enable a thermite reaction together with aluminum. The specific constituents and the respective proportions by mass thereof in the respectively produced or provided first component (A) and/or second component (B) will be chosen by the person skilled in the art according to the needs of the individual case.

The method of the invention is more preferably suitable for the production of casting prototypes; it enables individual manual adaptations of geometry (especially of the first boundary region), such that iterative optimization of the production method is simplified. For example, it is possible without a disadvantageously high expenditure of time and/or costs, in individual casting experiments, to test whether and, if so, at what positions the use of exothermic heating pads for later mass production seems viable.

If, for example, in first casting operations using a casting mold of the casting prototype, there is cavity formation in or on the casting prototype, preferably individual or multiple regions of the corresponding casting mold are reconfigured with the aid of the method of the invention such that they correspond essentially to an exothermic heating pad in terms of function.

In many cases, in methods according to the invention, the kneading in the manual modeling of self-curing molding compound onto the surface of base bodies of casting molds results in replication of the outlines of these base bodies by the molding compound without having to create a molding box and without having to dose more than the first component (A) and the second component (B) on site in the foundry; at the same time, given a suitable selection of material (see above), the result is a cured shaped product or a region of the article that can be made to react in a thermite reaction by heating, preferably by heating by contact with liquid casting metal. In such method configurations, individual or multiple regions of the casting mold are thus configured in a time-, cost- and resource-conserving manner such that they correspond in terms of function essentially to an exothermic heating pad.

Thus (without complex separate production of exothermic heating pads), casting molds are produced, in which one or more regions release thermal energy on contact with casting metal and hence influence the solidification characteristics of the casting metal in those regions in a controlled manner. The customary disadvantages that are associated with the production of exothermic heating pads are wholly or partly avoided in many cases in the case of performance of the method of the invention; these disadvantages are, for example, (i) the costly production of suitable tools for production of the exothermic heating pads that are adapted to the needs of the individual case and/or producing of exact geometric data of the model, (ii) the large amount of time taken, often an unacceptably large amount of time in the field of industrial foundry operation, in the production of exothermic heating pads, and (iii) the high costs that are associated overall with the production of exothermic heating pads. The method of the invention, in many cases, leads to comparable, preferably equivalent, results with complete or partial avoidance of the aforementioned disadvantages.

Preferably, the method of the invention, without undesirably high expenditure of costs and/or time, in the manner of a test method, determines whether use of exothermic heating pads can avoid cavity formation.

Moreover—if the procedure has been found to be fundamentally suitable—the method of the invention can determine, preferably without undesirably high expenditure of costs and/or time, the points at which, the volumes in which and the number in which exothermic heating pads should be used in a respective casting mold for casting prototypes in order to avoid cavity formation.

The mass production of exothermic heating pads in that case is thus preceded by the method of the invention.

In the method of the invention, it is preferable in many cases that the molding compound composed of the first component (A) and the second component (B) that arises in step (S2) is kneaded before curing (and preferably shaped in the course of or after kneading, especially molded or modeled onto an article), and is then present in the cured shaped product after step (S3) or in the article on conclusion of the production method such that it can be made to react in a thermite reaction by heating.

Preference is given to a method of the invention (as described above, preferably as identified above as preferred), wherein the shaping in step (S3) is manual or automated, preferably manual, and/or (preferably "and")

the producing of the second boundary region involves shaping a molding material (i.e. a molding material mixture comprising mold base material (e.g. refractory mold base material or thermally insulating filler), binders and optionally additives) using an automated shaping system.

In some cases, it is preferable when, in step (S3), the shaping of the self-curing molding compound that arises in step (S2) is automated, more preferably with use of apparatus aids, especially a shaping device. The shaping device is preferably supplied, in repeating sequence, with the self-curing molding compound that arises in step (S2). In such cases, the self-curing molding compound is used to produce a curable article in a continual sequence. Preference is given to producing "exotablets" or "exothermic lids" in an automated manner from the self-curing molding compound, which are used, for example, in conjunction with natural feeders. The term "exotablet" refers to a solid tablet produced from a molding compound or molding material, as sold, for example, as "exotablet" by HA KOVOCHEM. Exotablets regularly lose strength under the action of heat released on casting with casting metal, and can possibly break down to give a powder that reacts exothermically, and hence function as exothermic feeder cover.

By means of the "exotablets" or "exothermic lids" produced, the casting operation brings about closure of the feeder on the top side of the melt and hence thermal insulation, and the preferably exothermic action thereof prevents premature cooling of the melt within the feeder.

In many cases, especially when the self-curing molding compound is being kneaded, it is preferable, however, when the shaping in step (S3) is effected manually, regardless of how further processing steps are effected.

In an alternative or optional configuration of the method of the invention, the producing of the second boundary region involves shaping a molding compound using an automated shaping system, preferably a shaping system with vertical shape separation. This preferably results at least in the part of the casting mold that forms the second boundary region, adjacent to the first boundary region for accommodation of casting metal.

Such shaping systems preferably have two model halves, of which one model half is especially fixed or mounted on an essentially movable, more preferably linearly movable plunger, and the second mold half is mounted on a preferably pivotable and simultaneously linearly movable mold plate. The first and second model halves form at least the lateral boundary of a shaping chamber in the shaping system, into which the molding material is introduced for formation of the second boundary region of the article to be produced. The second boundary region that at least partly forms the article may be shaped with or without the self-curing molding compound that forms the first boundary region to give part of the casting mold.

Preference is given to a method of the invention (as described above, preferably as identified above as preferred), wherein the first boundary region of the article is first formed and then the second boundary region is shaped onto the first boundary region, preferably by shaping the first boundary region onto a shaping model, or the second boundary region of the article is first shaped and then the first boundary region is shaped onto the second boundary region.

Details will be apparent from the appended drawings and the elucidations further down in the present text.

Preference is given to a method of the invention (as described above, preferably as identified above as preferred), wherein the mixing by contacting of the first component (A) and the second component (B) in step (S2) is at least partly manual, preferably exclusively manual, and/or at least partly without electrical assistance of the mixing operation.

In preferred configurations, the mixing by contacting in step (S2) merges directly into subsequent method steps, for example into shaping steps (preferably step (S3)). Preference is given in each case to manual mixing by contacting; however, the mixing by contacting may also be assisted or performed by machine.

Preferably, in the method of the invention, the mixing by contacting is conducted manually, especially when the self-curing molding compound is kneaded in the method, preferably kneaded manually. More preferably, the mixing by contacting is conducted manually.

Preference is given to a method of the invention (as described above, preferably as identified above as preferred), having the following step:

filling an intended or unintended recess (i.e. completion or repair) in a surface region of a mold part, preferably a region for bounding of at least sections of a cavity to accommodate cast metal, with the self-curing molding compound that arises in step (S2).

This method is used, for example, when repairs of surface defects in casting molds are to be performed particularly rapidly, and especially when it is undesirable for the casting mold to be transported for a repair. In many cases, it is preferable when, in the performance of the method of the invention, the mixing by contacting of the first component (A) and the second component (B) in step (S2) is manual (see above). The method of the invention is then conducted on site in many cases such that there is no delay in the sequence of operation. A contributory factor in this regard is the preferably manual mixing by contacting of just two components in a predetermined mass ratio with one another, and preferably the kneading. In this way, the method can be conducted manually in a particularly simple manner.

Moreover, the method of the invention is used rapidly and in a resource-efficient manner where only individual regions of a casting mold are to be endowed with insulating or exothermic properties. For example, such regions of a casting mold are first intentionally recessed or cleared and then filled with the self-curing molding compound in the method of the invention, i.e. completed.

The filling of a recess on the mold part for the purpose of repair or completion by the self-curing molding compound preferably retroactively forms the first boundary region. The molding compound directly adjoins the molding material that forms the second boundary region. A recess in a surface region of the article is preferably filled using a model section that can be placed on in this region or a form gauge. This ensures that, in the region of a recess filled by means of the self-curing molding compound, a predetermined outline is created in the article, especially in the casting mold, and hence a desired shape of the casting to be produced.

Preference is given to a method of the invention (as described above, preferably as identified above as preferred), wherein the first component (A) and/or the second component (B) comprises a catalyst (c) for catalyzing the chemical reaction between the first binder component (b1) and the second binder component (b2).

In many cases, it is preferable when the first component (A) and/or the second component (B) comprises a catalyst (c) that catalyzes the chemical reaction between the first binder component (b1) and the second binder component (b2).

The use of a suitable catalyst in many cases allows acceleration of the curing or adjustment of the setting time so as to result in a reproducible period of time for the curing of the self-curing molding compound, hence allowing the method to be performed in many cases in a particularly predictable and resource-conserving manner, and especially without any delay to other operating sequences in the foundry.

Preference is given to a method of the invention (as described above, preferably as identified above as preferred), wherein a constituent of the mold base material used in step (S1), preferably as mold base material, in the first component (A) and/or the second component (B) is refractory mold base material designated as refractory according to DIN 51060, preferably selected from the group consisting of:

natural and synthetic mold base mixtures and materials thereof, preferably wholly or partly selected from the group consisting of:

quartz sand, zircon sand or chromite sand, olivine, vermiculite, bauxite, fireclay and mixtures thereof;

and/or a constituent of the mold base material used in step (S1), preferably as mold base material, in the first component (A) and/or the second component (B) is thermally insulating filler, preferably selected from the group consisting of:

hollow bodies, preferably hollow spheres of fly ash, porous bodies, preferably perlite, calcined rice husk ash, calcined kieselguhr, closed-pore microspheres, core-shell particles;

and/or the first component (A) comprising binder component (b1)

and/or the second component (B) comprising binder component (b2)

additionally comprise(s) one, two, three or more further ingredients independently selected from the group consisting of:

metallic materials selected from the group consisting of aluminum, magnesium, silicon, titanium, alloys thereof and mixtures thereof with one another or with other metallic materials, metal oxide, preferably selected from the group consisting of iron oxide, manganese oxide and mixtures thereof, lithium silicate cordierite and alkali metal nitrate, preferably selected from the group consisting of sodium nitrate, potassium nitrate and mixtures thereof.

The ingredients listed and the use thereof in molding compounds or in articles produced therefrom are known to the person skilled in the art. What is meant by independent selection of one, two, three or more further ingredients from the groups mentioned is that the selection of a first material has no effect on the selection of a subsequent material or the subsequent materials. Equally, the selection of any further material has no effect on the selection of the subsequent materials.

The person skilled in the art will choose the materials to be used according to the requirements of the individual case.

Preference is given to a method of the invention (as described above, preferably as identified above as preferred), wherein the binder system is selected from the group consisting of:

(G1) polyurethane no-bake systems, wherein the first binder component (b1) is preferably a polyol component, preferably selected from the group consisting of phenolic resins, preferably ortho-, ortho' fused phenolic resols, and aliphatic polyol compounds, and the second binder component (b2) is a polyisocyanate component, preferably a polyisocyanate component comprising methylene-di(phenyl isocyanate), wherein the first component (A) and/or the second component (B), preferably component (A), contain (s) a catalyst (c), preferably selected from the group consisting of 4-phenylpropylpyridine and liquid amines, preferably methylimidazole or vinylimidazole;

(G2) acid-curing cold resins, where the first binder component (b1) is preferably selected from:

furan resins, phenolic resins or combinations thereof and the second binder component (b2) comprises one or more acidic constituents, independently selected from:

sulfonic acids, more preferably paratoluenesulfonic acid, xylenesulfonic acid, benzenesulfonic acid, methanesulfonic acid mixtures of sulfonic acids and organic acids, more preferably mixtures of sulfonic acids and lactic acid;

mixtures of inorganic acids, where preferably one or more sulfonic acids and/or one or more phosphoric acids are present in the mixture;

(G3) inorganic binder systems, preferably inorganic binder systems comprising waterglass, more preferably inorganic binder systems comprising (i) waterglass and esters or (ii) waterglass and amorphous particulate silicon dioxide;

(G4) epoxy resins, where the first binder component (b1) preferably comprises an epoxy compound, preferably selected from the group consisting of: glycidyl-based epoxy resins, bisphenol-based epoxy resins, novolak epoxy resins, aliphatic epoxy resins and/or halogenated epoxy resins, and the second binder component (b2) comprises a polyfunctional amine, preferably selected from the group consisting of: polyfunctional aromatic amines, preferably 1,3-diaminobenzene, polyfunctional aliphatic amines, preferably diethylenetriamine or 4,4'-methylenebis(cyclohexylamine) and/or dicarboxylic anhydrides, preferably hexahydrophthalic anhydride.

The use of polyurethane no-bake systems (G1) in the method of the invention is preferred in many cases. Polyurethane no-bake systems (G1) have the advantage over polyurethane cold-box binder systems used in the prior art, e.g. DE10104289 B1, that there is no need for gassing with a gaseous catalyst (tertiary amine), and hence for corresponding apparatus complexity.

It is generally preferable to conduct a method of the invention such that the curing of the self-curing molding compound that arises in step (S2) is not effected in the presence of gaseous catalysts and/or in the presence of gaseous co-reactants.

The first binder component (b1) of a polyurethane no-bake binder system (G1) as defined above does not contain any polyisocyanate, and the second binder component (b2) of a polyurethane no-bake binder system (G1) as defined above does not contain any polyol.

Depending on the requirements of the individual case, however, the use of a different binder system is preferable in some cases.

The first binder component (b1) of an acid-curing cold resin (G2) as defined above does not contain any acidic constituents selected from sulfonic acids, mixtures of sulfonic acids and organic acids, and mixtures of inorganic acids. The second binder component (b1) of an acid-curing cold resin (G2) as defined above does not contain any constituents selected from furan resins, phenolic resins and combinations thereof.

The use of acid-curing cold resins in the method of the invention is not preferred for those embodiments wherein the ingredients are to be made to react in a thermite reaction by suitable activation after the self-curing or curing. In principle, the formulation should be designed such that the constituents of the binder system do not react undesirably with other constituents of the molding compound. Aluminum reacts, for example, with acids and alkalis to release hydrogen; the corresponding combination should therefore be avoided.

When inorganic binder systems (G3) are used in the method of the invention, it is preferable when the first binder component (b1) comprises waterglass, preferably waterglass and surfactants, and the second binder component (b2) comprises esters, preferably esters and particulate amorphous $SiO_2$. In this preferred variant, the first binder component of the inorganic binder system (G3) does not comprise any ester or any particulate amorphous $SiO_2$, and the second binder component of the inorganic binder system (G3) does not contain any waterglass.

The first binder component (b1) of an epoxy resin binder system (G4) as defined above does not contain any polyfunctional amine, and the second binder component (b2) of an epoxy resin binder system (G4) as defined above does not contain any epoxy resin.

The person skilled in the art will choose the respective chemical compositions of the first binder component (b1) and the second binder component (b2) preferably in such a way that a reaction between ingredients of the first binder component (b1) and ingredients of the second binder component (b2) occurs only on mixing by contacting of the first component (A) and the second component (B) in step (S2).

Preference is given to a method of the invention (as described above, preferably as identified above as preferred), wherein the self-curing molding compound that arises in step (S2) comprises:

82% to 98% by weight, preferably 84% to 96% by weight, more preferably 86% to 96% by weight, of mold base material, most preferably 92% to 95%, and/or 2% to 18% by weight of constituents that are not mold base material, preferably 4% to 16% by weight, more preferably 4% to 14% by weight, most preferably 5% to 8% by weight, where the percentages by weight are based on the total mass of the self-curing molding compound.

The person skilled in the art will choose the minimum proportion of mold base material in the first component (A) and the second component (B) and in the self-curing molding compound that arises in step (S2) according to requirements of the individual case.

In many cases, in the method of the invention (as described above, preferably as identified above as preferred), preference is given to using refractory mold base materials; it is preferable here that the self-curing molding compound that arises in step (S2) comprises:

up to 84% by weight, preferably 40% to 80% by weight, more preferably 60% to 80% by weight, of refractory mold base material, preferably selected from the group consisting of:

natural and synthetic mold base mixtures and materials thereof, preferably wholly or partly selected from the group consisting of:

quartz sand, zircon sand or chromite sand, olivine, vermiculite, bauxite, fireclay and mixtures thereof.

In many cases, in the method of the invention (as described above, preferably as identified above as preferred), preference is given to using thermally insulating fillers; it is preferable here that the self-curing molding compound that arises in step (S2) comprises:

up to 84% by weight, preferably 40% to 80% by weight, more preferably 60% to 80% by weight, of thermally insulating fillers, preferably selected from the group consisting of:

hollow bodies, preferably hollow spheres of fly ash, porous bodies, preferably perlite, calcined rice husk ash, calcined kieselguhr, closed-pore microspheres, core-shell particles.

The person skilled in the art will choose the composition of the self-curing molding compound that arises in step (S2) according to the requirements of the individual case so as to result in articles having the properties that are respectively preferred in the individual case. More particularly, they will take note of the reactivity of the materials used with one another, and the density, thermal conductivity (insulating action) and thermal stability of the substances used.

Preference is given to a method of the invention (as described above, preferably as identified above as preferred), wherein the first mold base material and the second mold base material have essentially the same or an identical chemical composition or have a different chemical composition.

Both variants are preferable depending on the requirements of the individual case and will be chosen correspondingly by the person skilled in the art.

Preference is given to a method of the invention (as described above, preferably as identified above as preferred), wherein the first mold base material and the second mold base material have a different average grain diameter, or the first mold base material and the second mold base material have essentially the same average grain diameter and/or have an average grain diameter of less than 1.3 mm, preferably of 0.1 to 0.7 mm, more preferably of 0.1 mm to 0.5 mm.

The (average) grain diameter is determined by sieving according to VDG Merkblatt (i.e. worksheet from the "Verein deutscher Gießereifachleute" [Society of German Foundry Experts]) P 27 dated October 1999, point 4.3, which specifies the use of test sieves according to DIN ISO 3310.

Preference is given to a method of the invention (as described above, preferably as identified above as preferred), wherein the first and/or second mold base material is selected from the group consisting of natural and synthetic mold base materials and mixtures thereof, preferably wholly or partly selected from the group consisting of quartz sand, zircon sand or chromite sand, olivine, vermiculite, bauxite, fireclay and mixtures thereof, and/or wherein the first and/or second mold base material consists at least partly of recycled mold base material, preferably at least to an extent of 30% by weight of recycled mold base material, more preferably to an extent of at least 60% by weight, most preferably to an extent of at least 90% by weight.

Preference is given to a method of the invention (as described above, preferably as identified above as preferred), wherein, on contacting in step (S2), the temperature of the first component (A) and of the second component (B) are each within a range from 5 to 40° C.

Especially when there is manual mixing by contacting of the first component (A) and the second component (B) in the method of the invention in step (S2), preferably when there is manual mixing by contacting of the first component (A) and the second component (B) in the method of the invention in step (S2) and the self-curing molding compound is kneaded manually in one or more subsequent steps, preferably in a step (S3), preference is given to the temperature range specified here in step (S2). Thus, manual kneading can be effected without any need for heating or cooling between the mixing by contacting in step (S2) and the manual kneading in one or more subsequent steps, in order to create desirable working conditions for manual processing. However, the specified temperature range is also preferable in many other cases, for example when the self-curing shapeable compound is in free-flowing form or when there is no manual mixing in the method of the invention.

Preference is given to a method of the invention (as described above, preferably as identified above as preferred), wherein the cured molding compound comprises constituents that can be made to react with one another in a thermite reaction (preferably by heating), and/or (preferably "and")

the cured molding compound has a flexural strength of more than 100 N/cm$^2$, preferably more than 200 N/cm$^2$, more preferably more than 300 N/cm$^2$ (flexural strengths were determined by means of a +GF+ test bar and by means of a Multiserw flexural strength tester from MOREK, preferably determined with reference to VDG-Merkblatt P72 in its version of October 1999, points 4 and 5.3, using a GF test bar), and/or (preferably "and")

the shaping and curing of the self-curing molding compound that arises in step (S2) in step (S3) is effected within a period of 1 to 60 minutes, preferably within a period of 2 to 30 minutes, more preferably within a period of 5 to 20 minutes, most preferably within a period of 5 to 10 minutes.

With regard to the thermite reaction and the substances to be used therein, see the details above.

Preference is given to a method of the invention (as described above, preferably as identified above as preferred) of producing an article selected from the group consisting of casting mold, core and feeder, having the following steps after the mixing by contacting of the first component (A) and the second component (B) in step (S2):

placing the self-curing molding compound in a molding chamber or a molding box, preferably in contact with a shaping model or a model plate, wherein the placing preferably includes shaping of the self-curing molding compound, then, during the curing or after the curing of the self-curing molding compound, introducing a molding material into the molding chamber or the molding box, where the molding compound placed in the molding chamber or the molding box is preferably surrounded at least in regions by the molding material.

In this configuration of the method of the invention, the self-curing molding compound is specifically positioned in the molding chamber or the molding box; the preferred configuration envisages the placing of the self-curing molding compound in a molding chamber or a molding box, wherein the molding compound preferably comes into contact with a shaping model or a model plate. The self-curing molding compound is preferably disposed at a predetermined site or a predetermined position at which it comes into contact with the liquid casting metal on casting with liquid casting metal; preferably, the self-curing molding compound at the respective site or position contributes to keeping the casting metal in the liquid state over a minimum period of time, more preferably a predetermined minimum period of time.

Still during the curing of the self-curing molding compound or after the curing of the molding compound, in a subsequent step, a molding material is introduced into the molding chamber or the molding box; in many cases, a molding material having a different chemical composition than the composition of the self-curing molding compound that has been disposed in the molding chamber or the molding box in a preceding step is used for this purpose. The molding material added in the subsequent step then forms, in the resulting article, the second boundary region with different composition for bounding at least sections of a cavity for accommodating casting metal.

Preference is given to a method of the invention (as described above, preferably as identified above as preferred), wherein the placing of the self-curing molding compound in the molding chamber or the molding box comprises the step(s) of:

shaping the self-curing molding compound onto a model plate that bounds the molding chamber and/or onto a shaping model that forms the mold cavity of the article to be produced, wherein the self-curing molding compound preferably comprises constituents that can be made to react with one another in a thermite reaction (preferably by heating), and/or a casting mold with a feeder or core placed therein is produced by placing a feeder or core within the molding chamber or molding box, where a region of the feeder and/or of the core is a cured shaped product of the first component (A) and the second component (B).

With regard to the thermite reaction and the substances to be used therein, see the details above.

The shaping of the self-curing molding compound onto a model plate that bounds the molding chamber for the casting mold and/or onto a shaping model that forms the mold cavity of the article to be produced is preferably effected manually. The self-curing molding compound, after the mixing by contacting of the first component (A) and the second component (B), is shaped onto the intended regions of model plate and/or shaping model. More preferably, the regions of model plate and/or shaping model that have been endowed with the self-curing molding compound define surface regions which—after removal of model plate or shaping model—bound at least sections of a cavity for accommodation of casting metal.

Alternatively or optionally, the self-curing molding compound is disposed in the molding chamber or the molding box by inserting a feeder or core within the molding chamber or molding box. Rather than the introducing of a still-kneadable and then self-curing molding compound into the molding chamber or the molding box, preference is given to disposing an already cured molding compound as cured shaped product in the form of (part of) a feeder or a core in the molding chamber or the molding box. The cured shaped product is preferably formed in step (S3) of the method of the invention.

Such a feeder or core is a preferably prefabricated product which consists at least partly of the cured shaped product of the first component (A) and the second component (B), which have been mixed and shaped to give the product manually or in an automated manner, preferably manually. On contact with the casting metal introduced into the finished casting mold, there is preferably a thermite reaction in the cured shaped product, which keeps the casting metal in the liquid state for a prolonged period in the region of the cavity that has been endowed with the cured shaped product. This influences the solidification characteristics of casting regions in a controlled manner, and hence reduces, preferably avoids, unwanted material defects in the casting.

Preference is given to a method of the invention (as described above, preferably as identified above as preferred), wherein the article produced is separated from the model plate or the shaping model.

The article can be produced, for example, in a molding chamber of an automated shaping system; for this purpose, molding material is shot into the molding chamber and preferably compacted therein. The molding chamber is a molding space for production of the article, the wall regions of which define area regions of the article to be produced. Mold base materials used are preferably natural sands, semisynthetic molding sands or synthetic molding materials, which are introduced into the molding chamber, preferably shot into the molding chamber under high pressure.

The introducing of the molding material preferably precompacts the molding material. The molding material introduced into the molding chamber is preferably additionally compacted by a compressive force that acts on the molding material.

The compacting can be effected, for example, with the aid of two model plates of the automated shaping system that are movable relative to one another. In order to create the relative movement between the model plates, at least one of the model plates is moved linearly toward the other in relative terms. This reduces the distance between the model plates, and the molding material present therein is compressed.

The model plates that are essentially parallel to one another are surrounded peripherally by fixed chamber walls. After the compacting of the molding material, the article has solidified to such an extent that it can be separated from the model plate or shaping model. The separating of the article from the model plate and/or shaping model makes the cavity in the article produced accessible for accommodation of casting metal.

Rather than by means of an automated production process, the method of the invention is in many cases executed using a customary molding box with a high proportion of manual work.

The invention relates, in a further aspect, to an article selected from the group consisting of casting mold, core and feeder, producible by a method of the invention as described above, preferably as identified above as preferred, comprising a first region formed from a cured shaped product of the first component (A) and the second component (B), and a second region formed from a material of different composition.

The invention is based on the finding that, using an article of the invention that takes the form of a casting mold, core or feeder and is preferably producible by a method according to the above-described preferred embodiments, the production of a casting is enabled, the solidification characteristics of which are influenced in a controlled manner during the cooling operation, and hence the forming of material defects within the casting can be avoided. The article of the invention comprises at least one region, also referred to as first region, formed from a cured shaped product of the first component (A) and the second component (B). Preferably, such an article produced in accordance with the invention may have a plurality of such first regions composed of the cured shaped product.

The second region preferably consists of a material of different composition. The article preferably consists mainly, i.e. to an extent of more than 50%, preferably more than 80%, of said material having a different composition, and hence not of the product of the first component (A) and the second component (B).

Preference is given to an article of the invention (as described above, preferably as identified above as preferred), wherein the article, for bounding of at least sections of a cavity to accommodate cast metal, has a first boundary region and an adjacent, preferably adjoining, second boundary region of different composition, wherein the first boundary region is formed from the cured shaped product of the first component (A) and the second component (B).

On the article of the invention, the cured shaped product consisting of the first component (A) and the second component (B) forms at least one surface region by which at least sections of a cavity for accommodating cast metal are bounded. The cured shaped product of the first component (A) and the second component (B) that arises in step (S3) of a preferred method of the invention is preferably disposed close to the surface or forms parts of the surface of a mold cavity, for example in a casting mold, on a core or on a feeder.

In many cases, it is preferable when the cured shaped product comprises constituents that are reacted with one another in a thermite reaction on contact with liquid casting metal; therefore, the cured shaped product of the first component (A) and the second component (B) preferably has direct contact with the casting metal that has been introduced into the cavity of the casting mold or ascends within the feeder. As a result, the first boundary region of the cavity preferably formed from the cured shaped product of the first component (A) and the second component (B) is heated by the casting metal, and the initiation temperature to be attained for the thermite reaction that then proceeds is attained. The second boundary region that also bounds the cavity for accommodation of casting metal is formed from a material of different composition, for example a molding material which is used to form casting molds or individual mold parts of a casting mold or else for cores and/or feeders; corresponding molding materials are customary in the field of the foundry industry and are known to the person skilled in the art.

The invention additionally relates to a kit for use in a method (as described above, preferably as identified above as preferred), at least comprising

- as or in a first constituent of the kit, an amount of a first component (A), comprising a first binder component (b1) and mold base material
- as or in a second constituent of the kit, an amount of a second component (B), comprising a second binder component (b2) and mold base material, wherein the first and second constituents of the kit are in a spatially separate arrangement.

The advantages described above in connection with the method of the invention and articles of the invention are realized in a particularly advantageous manner with the kit of the invention.

The invention additionally relates, in a further aspect, to a method of producing a metallic casting by metal casting in a casting mold, comprising the steps of:

- producing an article selected from the group consisting of casting mold, core and feeder, by a method of the invention, as described above, preferably as identified above as preferred, and inserting the article for bounding of at least sections of a cavity to accommodate cast metal, wherein the article has a first boundary region and an adjacent, preferably adjoining, second boundary region of different composition, wherein the first boundary region is formed from the cured shaped product of the first component (A) and the second component (B),
- contacting the casting metal at least with the first boundary region of the article produced during the casting.

The method of the invention for production of a metallic casting contributes to production of a metallic casting in a simplified manner and influencing of the solidification characteristics thereof during the cooling in the casting operation such that no casting defects arise and the finished casting does not have any material defects. For this purpose, both the casting mold and a core to be used in the production of the casting, and also a feeder to be used customarily in the sealing of the cavity of the casting mold, may consist at least partly of a cured shaped product (a cured shaped molding compound) produced from the first component (A) and the second component (B). The method of the invention is especially suitable in the production of casting prototypes; it enables individual manual adjustments of the geometry (especially of the boundary region), such that iterative optimization of the production method is simplified.

The article produced in the first method step comprises (at least) a first boundary region which consists of a cured shaped product (a cured shaped molding compound), and by which the cavity is bounded at least in sections for accommodation of casting metal. Provided adjacent to that, preferably adjoining, is (at least) a second boundary region that has a different composition.

At the moment when the casting metal comes into contact with the first boundary region of the article produced during the casting operation, the first boundary region is heated. In preferred configurations, after attainment of a predetermined initiation temperature in the cured molding compound that forms the first boundary region of the cavity for the casting metal, a thermite reaction is initiated. As a result, in this configuration, particular volume regions of the casting metal are kept in liquid form until they solidify later than other volume regions of the casting metal; it is thus possible by means of the method of the invention to avoid or reduce the occurrence of casting defects within the casting. Reference is made to the corresponding details further up; they are applicable here as well.

The preferred embodiments or developments that are described further up with regard to the method of the invention for producing an article are at the same time also preferred embodiments of the article of the invention, of the kit for use and of the method of the invention for producing a metallic casting. The preferred embodiments or developments that are described with regard to the method of the invention for producing a metallic casting, the article of the invention and the kit for use are at the same time also preferred embodiments of the method of the invention for producing an article, and so forth.

The invention is elucidated in detail hereinafter by examples.

The mixing ratios used, the materials used, i.e. mold base materials, binder components, catalyst and other constituents, are merely illustrative, and it is also possible to use different concentrations, materials and material combinations; with regard to the corresponding properties see the description above.

The Pentex 34V44, Pentex 35V92, Pentex 36003 and Pentex 36003B components used were sourced from HA France (ZI de Pont-Brenouille, BP 309, 60723 Pont Ste Maxence, France). The quartz sand used is type H32 quartz sand from Quarzwerke GmbH.

Example 1—Producing and Using a Self-Curing Molding Compound

This example describes, by way of example, the performance of a method of the invention for producing a self-curing molding compound without and with use of thermite mixtures.

1.1 Producing a First Component (A)

1.1-1 Producing a first component (A) (without substances that can be made to react in a thermite reaction by heating); also referred to hereinafter as first component (A-0).

In an experiment (in a foundry), 1000 g of H32 quartz sand (from Quarzwerke GmbH, AFS grain fineness number 45; as an example—other mold base materials are also usable in the method of the invention), 70 g of Pentex 34V44 (o,o" fused phenolic resol in aliphatic solvent; as an example of a first binder component (b1)—other substances are also usable in the method of the invention as first binder component (b1)) and 1.4 g of Pentex 36003 (methylimidazole in aromatic solvent; corresponding to 2% by weight, based on the amount of Pentex 34V44 used; as an example of a catalyst—other catalysts are also usable in the method of the invention) were placed in a first vessel (vessel 1.1-1), transferred into a vibratory mixer (from KLEIN, model SM511) and mixed for 30 seconds, so as to result in a mixture as an example of a first component (A), comprising a first binder component (b1) of a binder system and an amount of a first mold base material.

1.1-2 Producing a first component (A) (with substances that can be made to react in a thermite reaction by heating); also referred to hereinafter as first component (A-T).

In the composition according to example 1.1-1, the 1000 g of quartz sand was replaced by a customary thermite mixture comprising aluminum powder, pulverulent $Fe_2O_3$, potassium nitrate powder, fillers and starter (by way of example of substances that can be made to react with one another in a thermite reaction by heating) and, rather than vessel 1.1-1, vessel 1.1-2 was used. Apart from these changes according to the procedure from example 1.1-1, a mixture was thus produced as an example of a first component (A) (component (A-T)), comprising a first binder component (b1) of a binder system, an amount of a first mold base material and substances that can be made to react with one another in a thermite reaction by heating.

1.2 Producing a Second Component (B)

1.2-1 Producing a second component (B) (without substances that can be made to react with one another in a thermite reaction by heating); also referred to hereinafter as second component (B-0).

In an experiment (in a foundry), 1000 g of H32 quartz sand (from Quarzwerke GmbH, AFS grain fineness number 45; as an example—other mold base materials are also usable in the method of the invention), 70 g of Pentex 35V92 (p-MDI in aliphatic solvent) as an example of a second binder component (b2)—other substances are also usable in the method of the invention as second binder component (b2), were placed in a second vessel (vessel 1.2-1) spatially separate from the first vessel (vessel 1.1-1 or 1.1-2) and mixed with a vibratory mixer (from KLEIN, model SM511) for 30 seconds so as to result in a mixture as an example of a second component (B) (component (B-0)), comprising a second binder component (b2) of a binder system and an amount of a second mold base material.

1.2-2 Producing a Second Component (B) (with Substances that can be Made to React with One another in a thermite reaction by heating); also referred to hereinafter as second component (B-T).

In the composition according to example 1.2-1, the 1000 g of quartz sand was replaced by a customary thermite mixture, comprising aluminum powder, pulverulent $Fe_2O_3$, potassium nitrate powder, fillers and starter (by way of example of substances that can be made to react with one another in a thermite reaction by heating) and, rather than vessel 1.2-1, vessel 1.2-2 was used. Apart from these changes according to the procedure from example 1.2-1, a mixture was thus produced as an example of a second component (B) (component (B-T)), comprising a second binder component (b2) of a binder system, an amount of a second mold base material and substances that can be made to react with one another in a thermite reaction by heating.

1.3 Mixing by Contacting of the First Component (A) and the Second Component (B)

1.3-1 Mixing by Contacting of the First Component (A-0) Produced and the Second Component (B-0)

Respectively complete amounts produced of the first component (A) produced according to the above example 1.1-1 (component (A-0)) and of the second component (B) produced according to the above example 1.2-1 (component (B-0)), were transferred from their respective vessels (vessels 1.1-1 and 1.2-1) into separate screwtop vessels (vessels 1.1-1N and 1.2-1N) under nitrogen and stored for about 6 weeks.

In order to produce the self-curing molding compound, equal portions of component A (component (A-0)) and component B (component (B-0)) were mixed and kneaded intimately with one another by hand in a manually contacting manner for about 2 minutes in a mixing vessel (vessel 1.3-1), so as to result in a self-curing molding compound.

1.3-2 Mixing by Contacting of the First Component (A-T) Produced and (B-T) to Give a Self-Curing Molding Compound Respectively complete amounts produced of the first component (A) produced according to the above example 1.1-2 (component (A-T)) and of the second component (B) produced according to the above example 1.2-2 (component (B-T)), from their respective vessels, were transferred into separate screwtop vessels (vessels 1.1-2N and 1.2-2N) under nitrogen and stored for about 6 weeks. In order to produce the self-curing molding compound, equal portions of component A (component (A-T)) and component B (component (B-T)) were mixed and kneaded intimately with one another by hand in a manually contacting manner for about 2 minutes in a mixing vessel (vessel 1.3-2), so as to result in a self-curing molding compound.

N.B.: In an analogous manner, it is also possible to combine (A-0) with (B-T) or (A-T) with (B-0).

1.4 Shaping the Self-Curing Molding Compound onto a Prototype Model

One self-curing molding compound produced and kneaded according to the above examples 1.3-1 and 1.3-2 in each case was shaped onto a prototype model by compressive kneading and left thereon for self-curing at room temperature (about 20° C.). After a waiting time of about 30 minutes, the respective self-curing molding compound had cured to such an extent that it was usable as part of a mold part in iron casting.

1.5 Repairing a Base Body

Two casting molds, each with a surface defect (defect volume about 20 cm 3), were provided as base body (precursor). One self-curing molding compound produced and kneaded according to the above examples 1.3-1 and 1.3-2 in each case was shaped into the respective surface defect by compressive kneading; subsequently, with the aid of a spatula, the outline of the introduced molding compound was matched to the outline profile of the respective casting mold. After a waiting time of about 30 minutes at room temperature (about 20° C.), the respective self-curing molding compound had cured to such an extent as to result in a casting mold (as an example of an article produced by repair) that was usable in iron casting.

Example 2—Influence of the Amount of Binder on Strength and Processing Time

In order to ascertain the influence of the amount of binder on strength and processing time, mixtures having three different binder contents were produced. All examples were conducted with H32 quartz sand as substrate (mold base material).

2.1 Producing a First Component (A) (without Substances that can be Made to React with One Another in a Thermite Reaction by Heating)

In this experiment, 1000 g of H32 quartz sand (from Quarzwerke GmbH, AFS grain fineness number 45) and Pentex 34V44 (o,o" resol in aliphatic solvent) and Pentex 36003 (methylimidazole in aromatic solvent; corresponding to 2% by weight based on the amount of Pentex 34V44 used), each in the appropriate amounts according to table 1, were each placed in a first vessel (vessels 2.1-1, 2.1-2 and 2.1-3), transferred to a vibratory mixer (from KLEIN, model SM511) and mixed for 30 seconds, so as to result in each case in a mixture as an example of a first component (A) (component A1 or component A2 or component A3), comprising a first binder component (b1) of a binder system and an amount of a first mold base material.

A total of three mixtures were produced according to the formulations specified in table 1:

TABLE 1

| Component A | Vessel | Substrate: sand, H32 [g] | Pentex 34V44 resin [g] | Pentex 36003 catalyst [g] |
|---|---|---|---|---|
| A1 | 2.1-1 | 1000 | 30 | 0.6 |
| A2 | 2.1-2 | 1000 | 50 | 1.0 |
| A3 | 2.1-3 | 1000 | 70 | 1.4 |

2.2 Producing the Second Component (B)

In this experiment, 1000 g of thermite mixture (Chemex) and Pentex 35V92 (p-MDI in aliphatic solvent), each in the appropriate amounts according to table 2, were each placed in a second vessel (vessels 2.2-1, 2.2-2 and 2.2-3), in each case spatially separate from the first vessel (vessels 2.1-1, 2.1-2 and 2.1-3), transferred into a vibratory mixer (from KLEIN, model SM511) and mixed for 30 seconds, so as to result in each case in a mixture as an example of a second component (B) (component B1 or component B2 or component B3), comprising a second binder component (b2) of a binder system and an amount of a second mold base material.

A total of three mixtures were produced according to the formulations specified in table 2:

TABLE 2

| Component B | Vessel | Substrate: Chemex thermite mixture [g] | Pentex 35V92 [g] |
|---|---|---|---|
| B1 | 2.2-1 | 1000 | 30 |
| B2 | 2.2-2 | 1000 | 50 |
| B3 | 2.2-3 | 1000 | 70 |

2.3 Mixing the First Component (A) Produced and the Second Component (B) Produced Respectively complete amounts produced of the first component (A) produced according to the above example 2.1 and of the second component (B) produced according to the above example 2.2, from their respective vessel (vessels 2.1-1, 2.1-2 and 2.1-3 with component (A); vessels 2.2-1, 2.2-2 and 2.2-3 with component (B)), were filled into separate screwtop vessels (vessels 2.1-1N, 2.1-2N, 2.1-3N with component (A); vessels 2.2-1N, 2.2-2N and 2.2-3N with component (B)) under nitrogen and stored for about 6 weeks. In order to produce the self-curing molding compound, respectively equal portions by weight of component (A) and component (B) were mixed and kneaded intimately with one another in a respective third mixing vessel (vessels 2.3-1, 2.3-2 and 2.3-3) in a manually contacting manner for about 2 minutes; in each case, component (A1) (according to table 1) was mixed with component (B1) (according to table 2), component (A2) (according to table 1) with component (B2) (according to table 2) and component (A3) (according to table 1) with component (B3) (according to table 2), so as to result in each case in a self-curing molding compound; molding compound (F2-1) from components (A1) and (B1), molding compound (F2-2) from components (A2) and (B2), molding compound (F2-3) from components (A3) and (B3).

2.4 Shaping the Self-Curing Molding Compound onto a Prototype Model

One self-curing molding compound kneaded according to the above example 2.3 in each case (molding compounds (F2-1), (F2-2) and (F2-3)) was shaped onto a prototype model by kneading compression and left thereon for self-curing at room temperature (about 20° C.). After a waiting time of about 30 minutes, the self-curing molding compound had in each case cured to such an extent that it was usable as part of a mold part in iron casting.

2.5 Repairing a Base Body

One casting mold with a surface defect (defect volume about 20 cm 3) in each case was provided as base body (precursor). One self-curing molding compound kneaded according to the above example 2.3 in each case (molding compounds (F2-1), (F2-2) and (F2-3)) was shaped into the respective surface defect by compressive kneading; subsequently, with the aid of a spatula, the outline of the introduced molding compound was matched to the outline profile of the respective casting mold. After a waiting time of about minutes at room temperature (about 20° C.), the self-curing molding compound had in each case cured to such an extent as to result in a casting mold (as an example of an article produced by repair) that was usable in iron casting.

2.6 Studies of the Work Time of Molding Material Mixtures

The work time of the mixture (cf. figures under "Work time" in table 3)) is determined by in each case placing one molding compound freshly produced according to the above example 2.3 in each case (molding compounds (F2-1), (F2-2) and (F2-3)) in a vessel (vessels 2.6-1, 2.6-2 and 2.6-3), manually compacting the mixture in each case, and smoothing the surface. Immediately after the smoothing, a stopwatch is started. The surface is then tested at regular intervals with a shape compression tester (GF80 type, from Georg Fischer AG) by the ball indentation method (ball diameter 4 mm) until a value of 80 has been attained. This time is noted for the "work time" of the mixture in minutes (rounded) (cf. figures under "Work time" in table 3).

2.7 Studies of the Strip Time of Molding Material Mixtures

The strip time of the mixture (cf. figures under "Strip time" in table 3) was determined with a tester (model VC40, from PROLABO) as follows: the respective mixture that has been freshly produced according to the above example 2.3 (molding compounds (F2-1), (F2-2) and (F2-3)) is placed in a vessel (vessels 2.7-1, 2.7-2 and 2.7-3), the mixture is manually compacted in each case and the surface is smoothed. Immediately after the smoothing, a stopwatch is started. The vessel is placed in each case under the needle (weight 300 g, diameter 1 mm) of the tester and the test is conducted until the needle no longer penetrates into the sand mixture. At this time, the stopwatch is stopped and the time is noted as the strip time in minutes (rounded) (cf. figures under "Strip time" in table 3).

TABLE 3

| Mixture for molding compound Name | Pentex portion 1 (phenolic resin component - see above) Name | % by wt. (based on the sand used) | Pentex portion 2 (isocyanate component - see above) Name | % by wt. (based on the sand used) | Total binder content Binder content (% by wt. based on the total mass of the molding material mixture) | Pentex portion 3 (catalyst) Name | % by wt. (based on Pentex 34V44, portion 1) | Work time [min] | Strip time [min] | Flexural strength after 1 h [N/cm$^2$] | Flexural strength after 24 h [N/cm$^2$] |
|---|---|---|---|---|---|---|---|---|---|---|---|
| F2-1 | 34V44 | 3 | 35V92 | 3 | 6 | 36003 | 2 | 11.5 | 26.0 | 70 | 220 |
| F2-2 | 34V44 | 5 | 35V92 | 5 | 10 | 36003 | 2 | 7.5 | 17.1 | 160 | 420 |
| F2-3 | 34V44 | 7 | 35V92 | 7 | 14 | 36003 | 2 | 5 | 12.3 | 280 | 460 |

Example 3—Influence of the Amount of Catalyst on Strength and Processing Time

In order to ascertain the influence of the amount of catalyst on strength and processing time, mixtures were produced with three different amounts of catalyst. All the examples were conducted with quartz sand as substrate (mold base material).

3.1 Producing a First Component (A)

In an experiment (in a foundry), 1000 g of H32 quartz sand (from Quarzwerke GmbH, AFS grain fineness number 45; as an example—other mold base materials are also usable in the method of the invention) and Pentex 34V44 (o,o" fused phenolic resol in aliphatic solvent; as an example of a first binder component (b1)—other substances are also usable in the method of the invention as first binder component (b1)) and Pentex 36003B (methylimidazole in aromatic solvent, corresponding to 2% by weight based on the amount of Pentex 34V44 used); as an example of a catalyst—other catalysts are also usable in the method of the invention), in amounts according to the stated amounts for mixtures for molding compounds F3-1, F3-2 and F3-3 in table 4, were placed in a respective first vessel (vessels 3.1-1, 3.1-2 and 3.1-3), each transferred into a vibratory mixer (from KLEIN, model SM511) and mixed for 30 seconds, so as to result in each case in a mixture as an example of a first component (A), comprising a first binder component (b1) of a binder system and an amount of a first mold base material.

3.2 Producing the Second Component (B)

In an experiment (in a foundry), 1000 g of H32 quartz sand (from Quarzwerke GmbH, AFS grain fineness number 45) and 5 g of Pentex 35V92 (p-MDI in aliphatic solvent) were placed in a second vessel (vessels 3.2-1, 3.2-2 and 3.2-3), spatially separate from the first vessel (vessels 3.1-1, 3.1-2 and 3.1-3), and mixed with a vibratory mixer from KLEIN, model SM511 for 30 seconds, so as to result in a mixture as an example of a second component (B), comprising a second binder component (b2) of a binder system and an amount of a second mold base material.

3.3 Mixing the First Component (A) Produced and the Second Component (B) Produced Respectively complete amounts produced of the first component (A) produced according to the above example 3.1 and of the second component (B) produced according to the above example 3.2, from their respective vessels (vessels 3.1-1, 3.1-2 and 3.1-3 with component (A); vessels 3.2-1, 3.2-2 and 3.2-3 with component (B)), were filled into separate screwtop vessels (vessels 3.1-1N, 3.1-2N and 3.1-3N with component (A); vessels 3.2-1N, 3.2-2N and 3.2-3N with component (B)) under nitrogen and stored for about 6 weeks. In order to produce the self-curing molding compound, respectively equal portions by weight of component (A) and component (B) were mixed and kneaded intimately in a mixing vessel (vessels 3.3-1, 3.3-2, 3.3-3, 3.3-4, 3.3-5 and 3.3-6) in a manually contacting manner for about 2 minutes, so as to result in a self-curing molding compound (in each case, the components (A) and (B) produced were mixed with one another so as to result in mixtures according to the formulations specified in table 4; molding compounds (F3-1), (F3-2) and (F3-3)).

3.4 Shaping the Self-Curing Molding Compound onto a Prototype Model

One self-curing molding compound kneaded according to the above example 3.3 in each case (molding compounds (F3-1), (F3-2) and (F3-3)) was shaped onto a prototype model by kneading compression and left thereon for self-curing at room temperature (about 20° C.). After a waiting time of about 30 minutes, the respective self-curing molding compound had cured to such an extent that it was usable as part of a mold part in iron casting.

3.5 Repairing a Base Body

One casting mold with a surface defect (defect volume about 20 $cm^3$) in each case was provided as base body (precursor). One self-curing molding compound kneaded according to the above example 3.3 in each case (molding compounds (F3-1), (F3-2) and (F3-3)) was shaped into the respective surface defect by compressive kneading; subsequently, with the aid of a spatula, the outline of the introduced molding compound was matched to the outline profile of the respective casting mold. After a waiting time of about minutes at room temperature (about 20° C.), the self-curing molding compound had in each case cured to such an extent as to result in a casting mold (as an example of an article produced by repair) that was usable in iron casting.

3.6 Studies of the Work Time of Molding Material Mixtures

The work time of the mixture (cf. figures under "Work time" in table 4) is determined by in each case placing one mixture freshly produced according to the above example 3.3 in each case (molding compounds (F3-1), (F3-2) and (F3-3)) in a vessel (vessels 3.6-1, 3.6-2 and 3.6-3), manually compacting the mixture in each case, and smoothing the surface. Immediately after the smoothing, a stopwatch is started. The surface is then tested at regular intervals with a shape compression tester (GF80 type, from Georg Fischer AG) by the ball indentation method (ball diameter 4 mm) until a value of 80 has been attained. This time is noted for the "work time" of the mixture in minutes (rounded) (cf. figures under "Work time" in table 4).

3.7 Studies of the Strip Time of Molding Material Mixtures

The strip time of the mixture (cf. figures under "Strip time" in table 4) was determined with a tester (model VC40, from PROLABO) as follows: the respective mixture that has been freshly produced according to the above example 3.3 (molding compounds (F3-1), (F3-2) and (F3-3)) is placed in a vessel (vessels 3.7-1, 3.7-2 and 3.7-3), the mixture is manually compacted in each case and the surface is smoothed in each case. Immediately after the smoothing, a stopwatch is started. The vessel is placed in each case under the needle (weight 300 g, diameter 1 mm) of the tester and the needle is moved down repeatedly until the needle no longer penetrates into the sand mixture. At this time, the stopwatch is stopped and the time is noted as the strip time in minutes (rounded) (cf. figures under "Strip time" in table 4).

TABLE 4

| Mixture for molding compound Name | Pentex portion 1 (phenolic resin component - see above) Name | % by wt. (based on the sand used) | Pentex portion 2 (isocyanate component - see above) Name | % by wt. (based on the sand used) | Total binder content Binder content (% by wt. based on the total mass of the molding material mixture) | Pentex portion 3 (catalyst) Name | % by wt. (based on Pentex 34V44, portion 1) | Work time [min] | Strip time [min] | Flexural strength after 1 h [N/cm$^2$] | Flexural strength after 24 h [N/cm$^2$] |
|---|---|---|---|---|---|---|---|---|---|---|---|
| F3-1 | 34V44 | 5 | 35V92 | 5 | 10 | 36003B | 6 | 14.0 | 25.2 | 140 | 330 |
| F3-2 | 34V44 | 5 | 35V92 | 5 | 10 | 36003B | 4 | 18.5 | 34.2 | 80 | 340 |
| F3-3 | 34V44 | 5 | 35V92 | 5 | 10 | 36003B | 2 | 20.5 | 44.05 | 50 | 350 |

Figure 2:
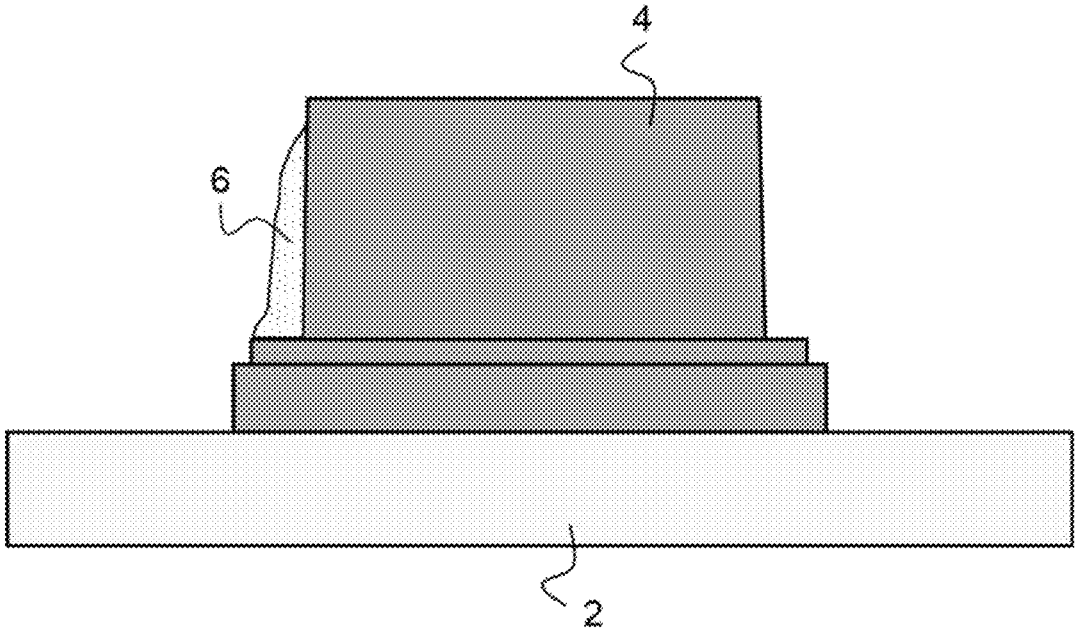
Figure 3:
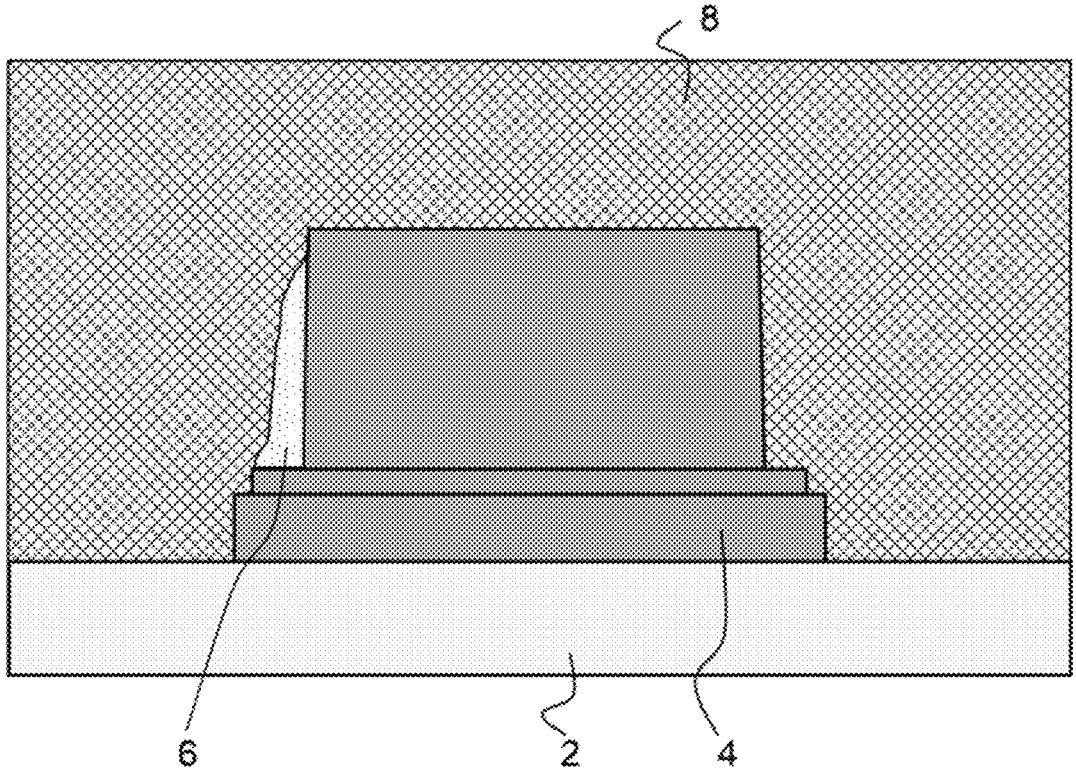
Figure 4:
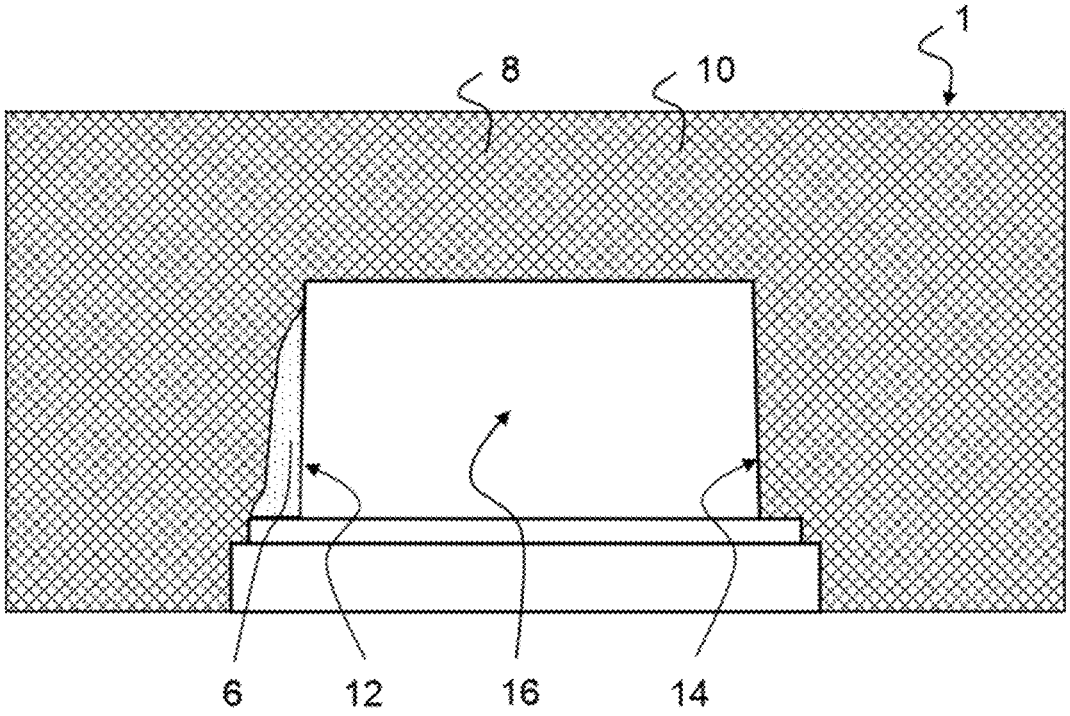
Figure 5:
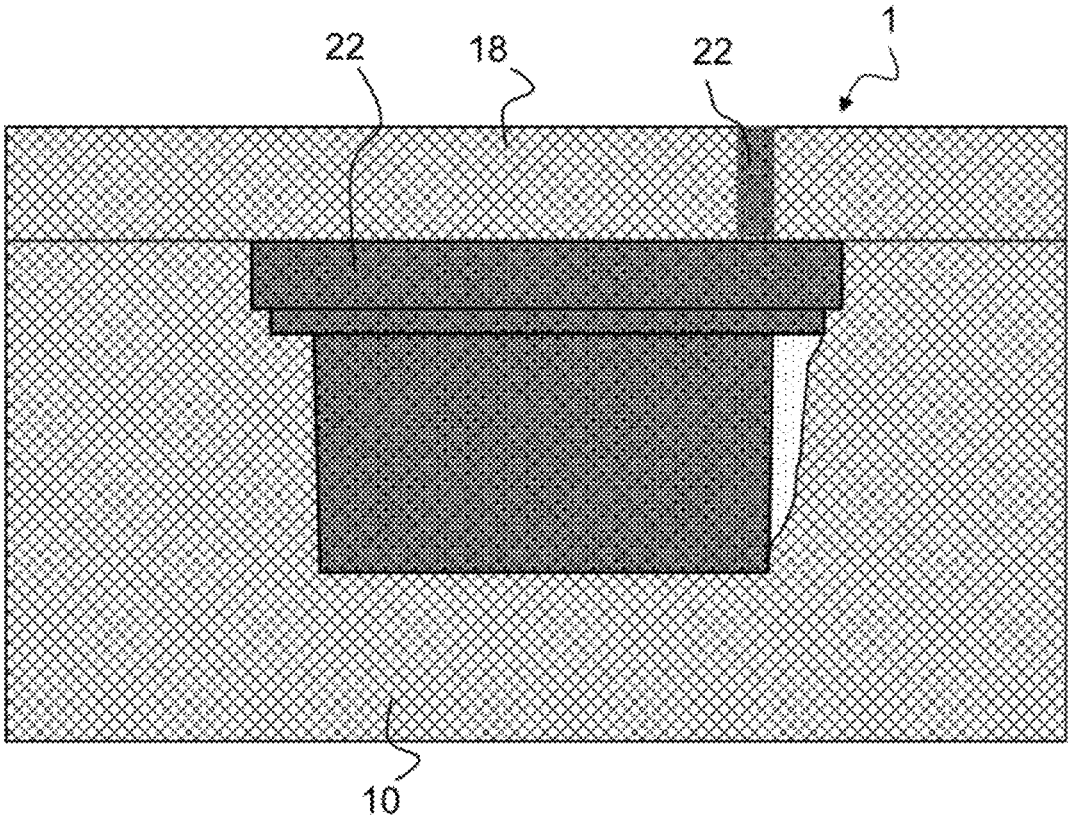
Figure 6:
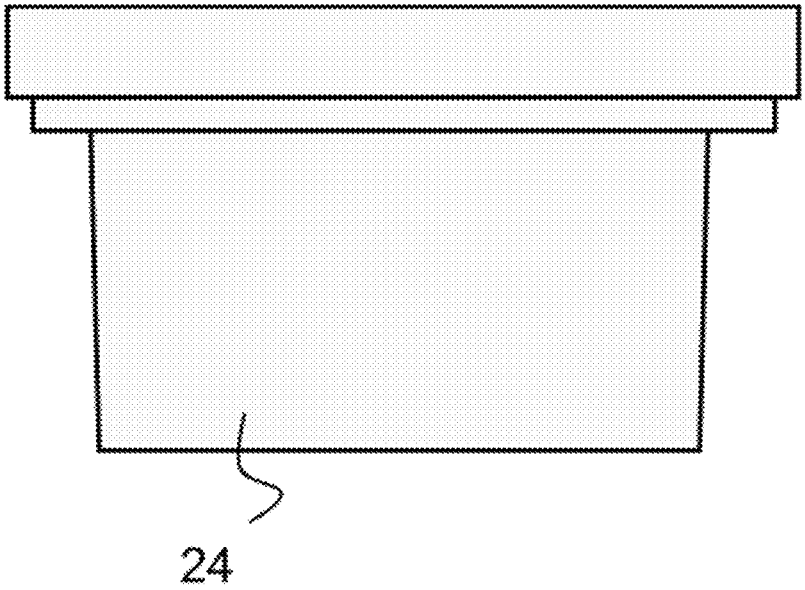

The invention is described in detail hereinafter with reference to a preferred working example of a method of producing an article or a casting with reference to the appended schematics figures. These show:

FIG. 1: a view of a model plate provided and of a shaping model disposed thereon;

FIG. 2: a view of the model plate and other model with a self-curing molding compound shaped onto a critical region for metal casting on the shaping model;

FIG. 3: a view of a detail from a molding chamber or molding box in which the model plate and the shaping model with the self-curing molding compound are disposed, wherein the molding chamber is filled with molding material;

FIG. 4: at least a partial view of the article produced, especially of a mold part of a casting mold created;

FIG. 5: a view of a casting mold which is composed of two mold parts and has a cured molding compound disposed in the cavity of the casting mold, wherein the casting mold is filled with casting metal; and FIG. 6: a view of a finished casting demolded from the casting mold.

FIG. 1 depicts a model plate 2 with a shaping model 4 disposed thereon, which is used in a method of producing an inventive article 1 (FIG. 4), preferably a casting mold, more preferably a first mold part 10 of a casting mold (FIG. 4).

The mold plate 2, in the case of customary use with the shaping model 4 disposed thereon, may be used, for example, in a molding box (not shown in detail), or forms a constituent of a molding chamber in the form of a mobile press plate (not shown in detail) of an automated shaping system. With the aid of the model plate 2, at least regions of the molding box or of the molding chamber of the shaping system are bounded.

According to FIG. 2, a self-curing molding compound 6 is disposed in, especially shaped onto, a "critical region" of the shaping model 4, wherein the molding compound 6 is preferably shaped by manual kneading. The molding compound has been produced by a method of the invention from a first component (A) and a second component (B) (reference is made to the remarks further up). The "critical region" refers to a region of the shaping model in the proximity of which material defects, especially cavities within the casting metal, can arise in particular in the solidification of the casting metal on account of insufficient further feeding. The shaping model corresponds essentially to the shape of the later casting, with the shaping model, taking account of the degree of shrinkage, possibly being correspondingly oversized relative to the finished casting. The molding compound 6 formed from a first component (A) and a second component (B), in accordance with a preferred configuration of the invention, comprises constituents that can be made to react with one another in a thermite reaction; these constituents were previously present in the first component (A) and/or the second component (B).

The molding compound 6 is preferably shaped by manual kneading onto the "critical region" of the shaping model 4 and cured thereon. In a configuration of the method of the invention which is not shown in detail, it is possible to arrange multiple amounts of such molding compounds 6 in uniform distribution around the circumference of the shaping model, in order thus to form a plurality of exothermic centers.

In a further embodiment, not shown in detail, the molding compound may take the form of a prefabricated contour pad. Rather than being arbitrarily shaped manually as a molding compound, the self-curing molding compound in this case is preferably shaped beforehand in a mold intended for the purpose to give a contour pad of predefined shape. Such a prefabricated and typically already cured contour pad has a shape matched to the respective region of the shaping model 4 on which the contour pad is to be placed. The contour pad is set or placed on the regions of the shaping model intended for the purpose and optionally fixed thereon.

FIG. 3 shows the result of a subsequent step of the method of the invention, in which a molding material 8 comprising a binder and a mold base material, for example a natural sand, semisynthetic molding sand or a synthetic mold base material, is introduced into the shaping box (not depicted in detail) or the molding chamber. After the molding material 8 has been introduced into the shaping chamber or the shaping box, it is compressed. The compression is effected by exerting a compressive force that acts on the molding material 8. The compressing and any associated curing process endows the molding material 8 with its necessary strength to form the article 1 of the invention, in the present context a mold part 10 of a casting mold, together with the molding compound 6.

As apparent from FIG. 3, the molding material 8 here surrounds the molding compound 6 shaped onto the shaping model 4. Compressing of the molding material 8 embeds the molding compound 6 into the molding material 8, such that a firm bond is established between the molding compound 6 and the molding material 8.

In a next step of the method that is preferred in accordance with the invention, the model plate 2 together with the shaping model 4 is separated from the mold part 10 produced. Beforehand, together with the separating or after the separating operation, the mold part 10 (including molding compound 6) is removed from the molding box (not shown) or the molding chamber. FIG. 4 shows the mold part 10 with the embedded molding compound 6 after performance of these measures.

As further illustrated by FIG. 4, the molding compound 6 formed especially from the first component (A) and the second component (B) forms a first boundary region 12 of the article 1, which bounds a section of a cavity 16 for accommodation of casting metal. The molding material 8 forms a second boundary region 14 which is adjacent to and preferably adjoins the first boundary region 12. The second boundary region 14 of the article 1, which likewise bounds a section of the cavity 16 for accommodation of casting metal, has a different composition than the boundary region 12 (and, for example, is not capable of a thermite reaction). Removal of the shaping model 4 from the mold part 10 produced has given rise to a mold cavity 16 that corresponds to at least a portion of a casting 24 to be produced (FIG. 6).

In a next step, the first mold part 10 (including the molding compound 6 that defines the first boundary region) as inventive article 1 is joined to a further mold part 18 to give a complete casting mold. After the joining, wherein the mold parts 10 and 18 are juxtaposed with sealing, the two mold parts 10 and 18 in the execution shown of the method of the invention are rotated by 180°. Thus, the mold part 18 now forms the top side of the article 1. Subsequently, a casting metal 22 is introduced via a mouth 20 that has been formed in the mold part 18 or produced subsequently in the mold part 18 into the cavity 16 of the article 1 which is preferably in the form of a casting mold, and this completely fills the cavity 16 and rises into the mouth 22. If the casting metal 22 comes into contact with the molding compound 6 that forms the first boundary region 12 of the cavity 16, the molding compound is heated to such an extent that an exothermic reaction, especially a thermite reaction, proceeds in the molding compound 6. As a result, the casting metal 22 in this region of the casting mold is kept in the liquid state for a prolonged period, which has an advantageous effect on the continued feeding process in the casting 24 to be produced. The result of this step is shown in FIG. 5.

After the conclusion of the casting operation and the solidifying of the casting metal 22 and the at least partial cooling of the casting 24 produced, the latter is removed from the casting mold and any casting residues present are removed. On conclusion of these measures, the finished casting 24 shown in FIG. 6 has then been produced.

LIST OF REFERENCE NUMERALS

1 article/casting mold
2 model plate
4 shaping model
6 molding compound
8 molding material
10 mold part
12 boundary region
14 boundary region
16 cavity
18 mold part
20 casting metal
22 mouth
24 casting

We claim:

1. A method of producing an article selected from the group consisting of
casting mold,
core
and feeder,
by repair or completion of a corresponding defective or incomplete article, having at least the following steps:
(S1) producing or providing in a foundry:
a first component (A), comprising a first binder component (b1) of a binder system and an amount of a first mold base material
and, spatially separated therefrom,
a second component (B), comprising a second binder component (b2) of the binder system and an amount of a second mold base material
wherein
the first binder component (b1) and the second binder component (b2) are suitable for chemical reaction with one another and for curing of a mixture of the first component (A) and the second component (B),
wherein the first binder component (b1) and the second binder component (b2) are each present as constituents of the first component (A) or the second component (B) in spatially separate containers,
(S2) mixing by contacting at least the first component (A) and the second component (B) that has been produced or provided spatially separately therefrom in a particular mass ratio, so as to result in a self-curing molding compound,
(S3) shaping and curing the self-curing molding compound that arises in step (S2), so as to result in a cured molded product of the first component (A) and of the second component (B), which forms a region of the article on conclusion of the production method.

2. The method as claimed in claim 1, wherein the self-curing molding compound that arises in step (S2) is kneaded in one or more subsequent steps by machine or manually.

3. The method as claimed in claim 1, wherein the article, for bounding of at least sections of a cavity to accommodate cast metal, has a first boundary region (12) and an adjacent, second boundary region (14) of different composition, wherein the first boundary region is formed from the cured shaped product of the first component (A) and the second component (B).

4. The method as claimed in claim 3 wherein
the shaping in step (S3) is manual or automated,
and/or
the producing of the second boundary region (14) involves shaping a molding material using an automated shaping system.

5. The method as claimed in claim 3, wherein
the first boundary region (12) of the article is first shaped and then the second boundary region (14) is shaped onto the first boundary region, wherein the first boundary region is shaped onto a shaping model (4)
or
the second boundary region of the article is first shaped and then the first boundary region is shaped onto the second boundary region.

6. The method as claimed in claim 1,
wherein the first component (A) and/or the second component (B) comprise constituents present at least in the cured shaped product after step (S3) or in the article after conclusion of the production method such that they can be made to react with one another in a thermite reaction by heating.

7. The method as claimed in claim 1, wherein the mixing by contacting of the first component (A) and the second component (B) in step (S2) is
at least partly manual,
or—at least partly without electrical assistance of the mixing operation.

8. The method as claimed in claim 1, having the following step:
filling an intended or unintended recess in a surface region of a mold part, with the self-curing molding compound that arises in step (S2).

9. The method as claimed claim 1, wherein
a constituent of the mold base material used in step (S1), in the first component (A) and/or the second component (B) is a refractory mold base material designated as refractory according to DIN 51060,
and/or
a constituent of the mold base material used in step (S1), in the first component (A) and/or the second component (B) is a thermally insulating filler, preferably
and/or
the first component (A) comprising binder component (b1)
and/or
the second component (B) comprising binder component (b2)
additionally comprise(s) one, two, three or more further ingredients independently selected from the group consisting of:
metallic materials selected from the group consisting of aluminum, magnesium, silicon, titanium, alloys thereof and mixtures thereof with one another or with other metallic materials, metal oxide,
lithium silicate,
cordierite,
and
alkali metal nitrate.

10. The method as claimed in claim 1, wherein the binder system is selected from the group consisting of:
(G1) polyurethane no-bake systems,
(G2) acid-curing cold resins,
(G3) inorganic binder systems,
and
(G4) epoxy resins.

11. The method as claimed in claim 1, wherein the self-curing molding compound that arises in step (S2) comprises:

82% to 98% by weight, where the percentages by weight are based on the total mass of the self-curing molding compound.

12. The method as claimed in claim 1, wherein the first mold base material and the second mold base material have an identical chemical composition or have a different chemical composition.

13. The method as claimed in claim 1, wherein, in the contacting operation in step (S2), the temperature of the first component (A) and of the second component (B) are each within a range from 5 to 40° C.

14. The method as claimed in claim 1, wherein the cured molding compound has a flexural strength of more than 100 N/cm$^2$, determined by means of a +GF+test bar and by means of a Multiserw flexural strength tester from MOREK, and/or— the shaping and curing of the self-curing molding compound that arises in step (S2),in step (S3), is effected within a period of 1 to 60 minutes.

15. The method as claimed in claim 1, having the following steps after the mixing by contacting of the first component (A) and the second component (B) in step (S2):

placing the self-curing molding compound that arises in step (S2) in a molding chamber or a molding box, then, during the curing or after the curing of the self-curing molding compound that arises in step (S2), introducing a molding material into the molding chamber or the molding box.

16. The method as claimed in claim 15, wherein the placing of the self-curing molding compound in the molding chamber or the molding box comprises the step(s) of:

shaping the self-curing molding compound onto a model plate that bounds the molding chamber and/or onto a shaping model that forms the mold cavity of the article to be produced, and/or a casting mold with a feeder or core placed therein is produced by placing a feeder or core within the molding chamber or molding box, where a region of the feeder and/or of the core is a cured shaped product of the first component (A) and the second component (B).

17. The method as claimed in claim 15, wherein the article produced is separated from the model plate or the shaping model.

18. The method as claimed in claim 1, wherein the method is conducted in such a way that the curing of the self-curing molding compound that arises in step (S2) is not effected in the presence of gaseous catalysts and/or not in the presence of gaseous co-reactants.

19. A method for producing a metallic casting by metal casting in a casting mold, comprising the steps of:

producing an article selected from the group consisting of casting mold, core and feeder by a method as claimed in claim 1, and inserting the article for bounding of at least sections of a cavity to accommodate cast metal, wherein the article has a first boundary region (12) and an adjacent, second boundary region (14) of different composition, wherein the first boundary region is formed from the cured shaped product of the first component (A) and the second component (B), contacting the casting metal at least with the first boundary region of the article produced during the casting.

* * * * *